US009476191B2

(12) United States Patent
Kitaura et al.

(10) Patent No.: US 9,476,191 B2
(45) Date of Patent: Oct. 25, 2016

(54) FLUSH TOILET APPARATUS

(71) Applicant: TOTO LTD., Fukuoka (JP)

(72) Inventors: Hidekazu Kitaura, Kitakyushu (JP); Ryoko Ishimaru, Kitakyushu (JP); Tomohiro Iwabata, Kitakyushu (JP); Yoshiki Ota, Kitakyushu (JP); Takashi Yoshioka, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 191 days.

(21) Appl. No.: 14/228,052

(22) Filed: Mar. 27, 2014

(65) Prior Publication Data

US 2014/0289944 A1 Oct. 2, 2014

(30) Foreign Application Priority Data

Mar. 27, 2013 (JP) ..... 2013-067139
Feb. 17, 2014 (JP) ..... 2014-028012

(51) Int. Cl.

| | |
|---|---|
| ***E03D 11/00*** | (2006.01) |
| ***E03D 1/00*** | (2006.01) |
| ***E03D 1/22*** | (2006.01) |
| ***E03D 1/06*** | (2006.01) |
| ***E03D 1/26*** | (2006.01) |

(52) U.S. Cl.
CPC ..... *E03D 1/263* (2013.01)

(58) Field of Classification Search
CPC ..... E03D 11/08; E03D 1/085
USPC ..... 4/432, 428, 368–370, 353, 363
See application file for complete search history.

(56) References Cited

U.S. PATENT DOCUMENTS 1,259,226 A * 3/1918 Gondolf ..... E03D 1/087 4/374
2,700,163 A * 1/1955 Sturman ..... E03D 1/125 137/446
6,502,251 B1 1/2003 Teshima et al.

FOREIGN PATENT DOCUMENTS

GB 822385 A * 10/1959 ..... E03D 1/012
WO 2005/106141 A1 11/2005

* cited by examiner

*Primary Examiner* — Huyen Le
*Assistant Examiner* — Christine Skubinna
(74) *Attorney, Agent, or Firm* — Studebaker & Brackett PC

(57) ABSTRACT

A flush toilet apparatus includes a tank and a jet pump unit. The tank includes: a first tank portion; and a second tank portion formed so as to extend part of a bottom wall of the first tank portion downward. The jet pump unit includes a throat pipe provided with a suction port that is an inlet of water, and at least the part of the second tank portion is formed at a position overlapping with the suction port when viewed from the top.

7 Claims, 14 Drawing Sheets

FLUSH TOILET APPARATUS

BACKGROUND OF THE INVENTION

1. Field of the Invention

The present invention relates to a flush toilet apparatus that discharges waste to a drain pipe by wash water.

2. Description of the Related Art

Examples of known systems for supplying wash water to a bowl portion of a flush toilet apparatus include a system of using high water pressure in a water pipe to supply water (direct-pressure type) and a system of supplying water from a tank arranged at a high place (tank type).

Since the direct-pressure-type flush toilet apparatus directly supplies water in the water pipe to the bowl portion, continuous washing is possible. However, if the apparatus is installed in an environment with a low water pressure in the water pipe, the flow rate of the wash water is reduced, and there is a problem that the washing performance is reduced.

Since the tank-type flush toilet apparatus uses potential energy of water stored in the tank to supply the water to the bowl portion, a large amount of wash water can be supplied without being affected by the water pressure in the water pipe. However, continuous washing is difficult because water needs to be poured into the tank after washing, and there is a problem that the flush toilet apparatus is not suitable for a situation in which the apparatus is frequently used.

Other than the apparatuses, a flush toilet apparatus with a system of supplying wash water to a bowl portion by a jet pump is proposed in recent years. For example, a flush toilet apparatus described in Japanese Patent Laid-Open No. 2004-156382 includes a tank storing water, and a jet pump unit is submerged and arranged inside of the tank. The jet pump unit includes a throat pipe. One end of the throat pipe is connected to a channel toward the bowl portion, and an opening is formed at the other end. When water is injected from an injection nozzle toward the inside of the throat pipe through the opening, a jet pump action is induced, and a large amount of water flows inside of the throat pipe toward the bowl portion. Not only the water injected from the injection nozzle, but also the water stored in the tank is drawn in and flows inside of the throat pipe. Therefore, a large amount of water is supplied to the bowl portion.

In this way, the flush toilet apparatus with the system of supplying wash water by the jet pump is configured to supply a large amount of water to the bowl portion by the jet pump action. This can suppress the reduction in the washing performance when the apparatus is installed in an environment with a low water pressure in the water pipe. The total amount of wash water supplied to the bowl portion is substantially equal to a sum of the amount of water stored in the tank and the amount of water injected from the nozzle. Therefore, the amount of water that needs to be stored in the tank is smaller than in the conventional tank type, and the tank can be downsized. Although water needs to be poured into the tank after the completion of washing of the bowl portion, the time required to pour water is shorter than in the tank type. Therefore, continuous washing is possible even if the flush toilet apparatus is frequently used.

To efficiently generate the jet pump action, it is desirable that the channel length of the throat pipe arranged in the tank is as long as possible. Therefore, when the dimension of the tank in the front-back direction is reduced to improve the design of the flush toilet apparatus, the throat pipe (long) is arranged so that the central axis of the throat pipe is substantially along the left-right direction of the tank when viewed from the top. The opening on the upstream end portion of the throat pipe is arranged at a position near one of left and right end portions inside of the tank.

However, according to the configuration, air in the tank may be sucked into the throat pipe when wash water is supplied to the bowl portion, although washing is not completed. This may reduce the efficiency of the jet pump action. Such a phenomenon may be caused by the fact that the entire water surface in the tank is not horizontal, because water at a position far from the opening of the throat cannot smoothly reach the opening of the throat pipe in a tank with a short dimension in the front-back direction. More specifically, the water level near the opening of the throat pipe drops earlier than the water level at other positions, and this may expose the opening of the throat pipe on the water surface at an early timing despite the fact that an amount of water necessary for washing is not supplied to the bowl portion. The difference between the water level near the opening of the throat pipe and the water level at the other positions is generated particularly when the water in the tank is reduced.

The present invention has been made in view of the problem, and an object of the present invention is to provide a flush toilet apparatus with a system of supplying wash water to a bowl portion by a jet pump, wherein high washing performance can be exerted without reducing the efficiency of a jet pump action, even if an opening on an upstream end portion of a throat pipe is arranged near one of left and right end portions in a tank.

SUMMARY OF THE INVENTION

To solve the problems, the present invention provides a flush toilet apparatus that discharges waste to a drain pipe by wash water, the flush toilet apparatus including: a toilet body including a bowl portion that receives waste, wherein a water conduit for guiding water supplied as wash water to the bowl portion is formed inside; a tank storing water inside and arranged to be able to supply the water to an inlet of the water conduit; and a jet pump unit arranged inside of the tank, the jet pump unit including: a throat pipe, wherein one end is connected to the inlet of the water conduit, a suction port is formed on the other end, a central axis of the throat pipe is arranged to be substantially along a left-right direction of the tank when viewed from the top, and the suction port is arranged to be positioned at a lower part near one of left and right end portions inside of tank; and a nozzle that injects high-speed water toward the inside of the throat pipe from the suction port to induce a jet pump action, wherein the tank includes: a first tank portion; and a second tank portion formed so as to extend part of a bottom wall of the first tank portion downward, and at least the part of the second tank portion is formed at a position overlapping with the suction port when viewed from the top.

The flush toilet apparatus according to the present invention includes the tank and the jet pump unit as mechanisms for supplying wash water to the bowl portion of the toilet body.

The tank stores water inside and is arranged to be able to supply the water to the inlet of the water conduit. The water conduit is a channel of water formed inside of the toilet body, and the water conduit is formed so that the water supplied from the inlet of the water conduit is guided to the bowl portion as wash water.

The jet pump unit is arranged inside of the tank and includes the throat pipe and the nozzle.

The throat pipe is a pipe, in which one end is connected to the inlet of the water conduit, and the suction port is formed on the other end. The suction port is an opening that serves as an inlet when the water stored in the tank is sucked inside of the throat pipe by the jet pump action as described later. The suction port is arranged on the lower part of the inside of the tank. The water stored inside of the tank flows inside of the throat pipe from the suction port and enters the water conduit. The water is guided to the bowl portion.

The throat pipe is arranged so that the central axis of the throat pipe is substantially along the left-right direction of the tank when viewed from the top, and the suction port is arranged near one of the left and right end portions inside of the tank. Since the throat pipe and the suction port of the throat pipe are arranged this way, the channel length of the throat pipe necessary to efficiently generate the jet pump action is ensured even if the dimension of the tank in the front-back direction is reduced.

The nozzle induces the jet pump action by injecting high-speed water from the suction port toward the inside of the throat pipe. When the high-speed water is injected from the nozzle toward the inside of the throat pipe, the water stored inside of the tank is drawn into the throat pipe by the water flow. As a result, the flow rate of the water flowing inside of the throat pipe toward the water conduit is higher than the flow rate of the water injected from the nozzle.

The tank includes: the first tank portion; and the second tank portion formed so as to extend part of the bottom wall of the first tank portion downward. At least part of the second tank portion is formed at a position overlapping with the suction port when viewed from the top.

According to the configuration, water at a position far from the suction port of the throat pipe heads to the suction port of the throat pipe after passing through the deep second tank portion. Since a relatively wide space is retained below the suction port, the flow of water toward the suction port is smooth even if the water in the tank is reduced. The occurrence of the phenomenon that the water level near the suction port of the throat pipe drops first is suppressed, and the entire water surface in the tank drops substantially horizontally. As a result, the air in the tank is not sucked into the throat pipe, and high washing performance by the jet pump action can be exerted.

In the flush toilet apparatus according to the present invention, it is also preferable that the tank is installed at a part on a backward side of an upper surface of the toilet body, and a bottom wall of the second tank portion does not overlap with the toilet body when viewed from the top and is arranged at a position on a lateral side of the toilet body and on a lower side of the upper surface of the toilet body.

According to this preferred aspect, the tank is installed at the part on the backward side of the upper surface of the toilet body. Therefore, the dimension of the entire flush toilet apparatus in the front-back direction can be reduced compared to when the entire tank is installed on the backward side of the toilet body.

The bottom wall of the second tank portion is arranged at the position not overlapping with the toilet body when viewed from the top and is arranged at the position on the lateral side of the toilet body and on the lower side of the upper surface of the toilet body. According to the configuration, the dimension in the front-back direction and the dimension in the height direction of the entire flush toilet apparatus are not enlarged by forming the second tank portion. In other words, the second tank portion can be formed without changing the dimensions, and the reduction in the efficiency of the jet pump action can be prevented.

In the flush toilet apparatus according to the present invention, it is also preferable that to set a center of gravity of entire water stored in the tank to a position closer to a side with the suction port in the left-right direction of the tank, the second tank portion is formed so that a capacity of the side with the suction port is greater than a capacity of a side without the suction port.

According to this preferred aspect, the tank is formed so that the center of gravity of the entire water stored in the tank is set at the position closer to the side with the suction port in the left-right direction of the tank. Specifically, the second tank portion as part of the tank is formed so that the capacity on the side with the suction port is greater than the capacity on the side without the suction port. As a result, the center of gravity of the entire water stored in the tank is biased as described above.

An example of the aspect of the tank includes formation of the second tank portion only on one side of the tank in the left-right direction. Another example of the aspect includes formation of the second tank portions on both left and right sides below the tank so as to sandwich the toilet body. The capacity of the second tank portion on one side (side with the suction port) is greater than the capacity of the second tank portion on the other side (side without the suction port).

The tank installed on the upper surface of the toilet body can be easily inclined toward the suction port by the weight of the tank, so that the center of gravity of the entire water stored in the tank is at the position closer to the side with the suction port in the left-right direction of the tank. If the tank inclines toward the suction port, the water stored in the tank smoothly and easily reaches the suction port. Therefore, the occurrence of the phenomenon that the water level near the suction port of the throat pipe drops first can be further suppressed.

In the flush toilet apparatus according to the present invention, it is also preferable that the tank is installed on the upper surface of the toilet body through an elastic member.

According to this preferred aspect, the tank is installed on the upper surface of the toilet body through the elastic member. According to the configuration, the tank installed on the upper surface of the toilet body can be further easily inclined toward the suction port by the weight of the tank.

In the flush toilet apparatus according to the present invention, it is also preferable that an entire edge of the suction port is formed along a horizontal surface.

According to this preferred aspect, the suction port formed on the end portion of the throat pipe is formed so that the entire edge of the suction port is along the horizontal surface. It can be stated that the suction port with the edge in such a shape is an opening formed when the end portion of the throat pipe is cut along the horizontal surface.

As already described, according to the present invention, the entire water surface in the tank drops substantially horizontally as a result of forming the second tank portion. According to this preferred aspect, the edge of the suction port is parallel to the water surface, and this prevents the air from entering inside of the throat pipe from the suction port even if the water level of the water stored inside of the tank is reduced to near the suction port. As a result, the amount of water remained in the tank at the end of washing can be reduced, and the tank can be further downsized.

In the flush toilet apparatus according to the present invention, it is also preferable that a water supply pipe that is a pipe for supplying water to be injected from the nozzle is arranged inside of the tank, extending upward from a bottom wall of the tank, and the water supply pipe is arranged at a part on an opposite side of the side with the suction port in the left-right direction of the toilet body.

According to this preferred aspect, the water supply pipe that is a pipe for supplying, from the outside (water pipe), water to be injected from the nozzle is arranged inside of the tank, extending upward from the bottom wall of the tank. In other words, the water supply pipe is arranged so that the water stored inside of the tank goes through in the vertical direction.

The water supply pipe is arranged at the part on the opposite side of the side with the suction port in the left-right direction of the toilet body inside of the tank. Since the water supply pipe is arranged at a position far from the suction port, the water supply pipe does not inhibit the flow of water toward the suction port. As a result, the occurrence of the phenomenon that the water level near the suction port of the throat pipe drops first can be further suppressed.

In the flush toilet apparatus according to the present invention, it is also preferable that inside of the tank, an open/close valve for switching open/close of a channel for supplying water to the nozzle and a float connected to the open/close valve are arranged, and the float is arranged at a part on the opposite side of the side with the suction port in the left-right direction of the toilet body inside of the tank.

According to this preferred aspect, the open/close valve for switching open/close of the channel for supplying water to the nozzle and the float connected to the open/close valve are arranged inside of the tank. According to the configuration, the open/close of the channel for supplying water to the nozzle can be switched at an appropriate timing according to the height of the water surface. The injection of water from the nozzle as well as the stop of the injection can be switched by a mechanical configuration, without using an electromagnetic valve or the like.

The float is arranged at the part on the opposite side of the side with the suction port in the left-right direction of the toilet body inside of the tank. Since the float is arranged at the position far from the suction port, the float does not inhibit the flow of water toward the suction port. As a result, the occurrence of the phenomenon that the water level near the suction port of the throat pipe drops first can be further suppressed.

In the flush toilet apparatus according to the present invention, it is also preferable that a small tank for enabling to change an amount of water, of the stored water, to be supplied to the inlet of the water conduit is arranged inside of the tank, and the small tank is arranged at a position closer to the opposite side of the side with the suction port in the left-right direction of the toilet body inside of the tank.

According to this preferred mode, the small tank for enabling to change the amount of water, of the stored water, to be supplied to the inlet of the water conduit is arranged inside of the tank. The small tank is arranged to realize a plurality of washing modes with different amounts of water supplied to the bowl portion, such as "large washing" and "small washing".

The small tank is arranged at the position closer to the opposite side of the side with the suction port in the left-right direction of the toilet body inside of the tank. Since the small tank is arranged at the position, the small tank does not inhibit the flow of water toward the suction port. As a result, the occurrence of the phenomenon that the water level near the suction port of the throat pipe drops first can be further suppressed.

DETAILED DESCRIPTION OF THE PREFERRED EMBODIMENTS

Figure 1:
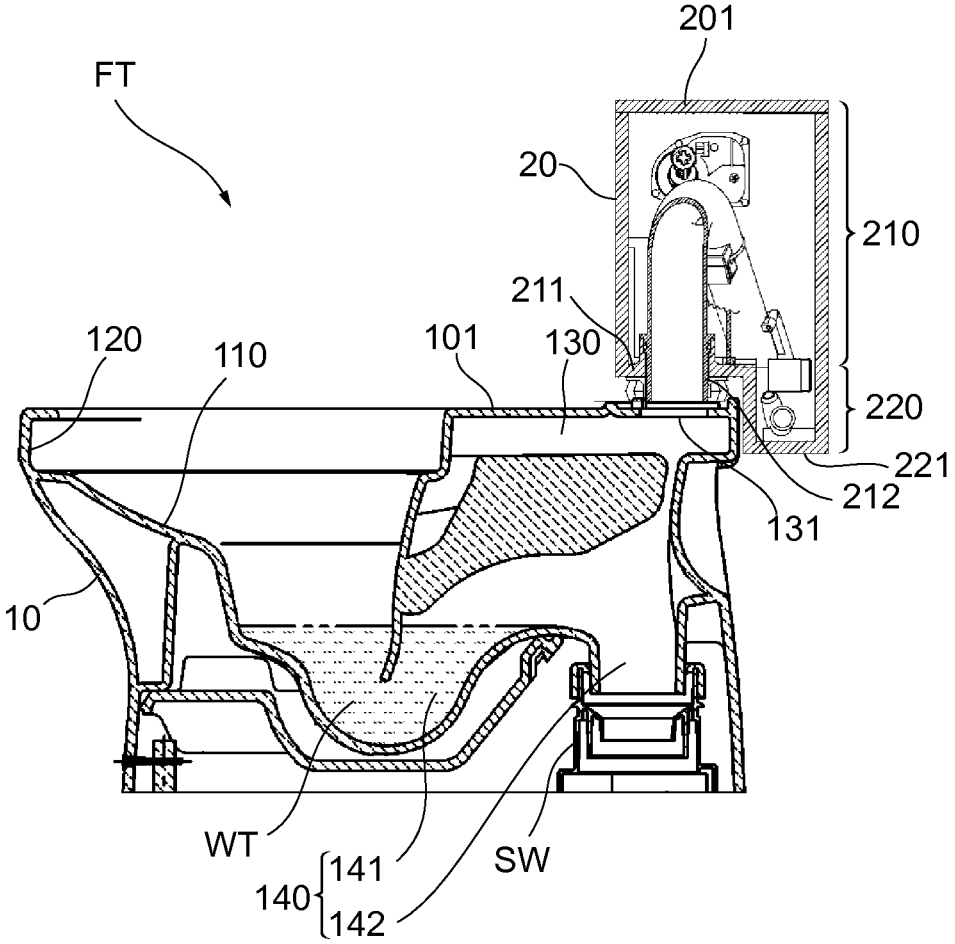
FIG. 1 is a cross-sectional view showing a flush toilet apparatus according to a first embodiment of the present invention.

Hereinafter, embodiments of the present invention will be described with reference to the attached drawings. To facilitate understanding of the description, the same reference numerals are provided to the same constituent elements in the drawings as much as possible, and the description will not be repeated.

Figure 2:
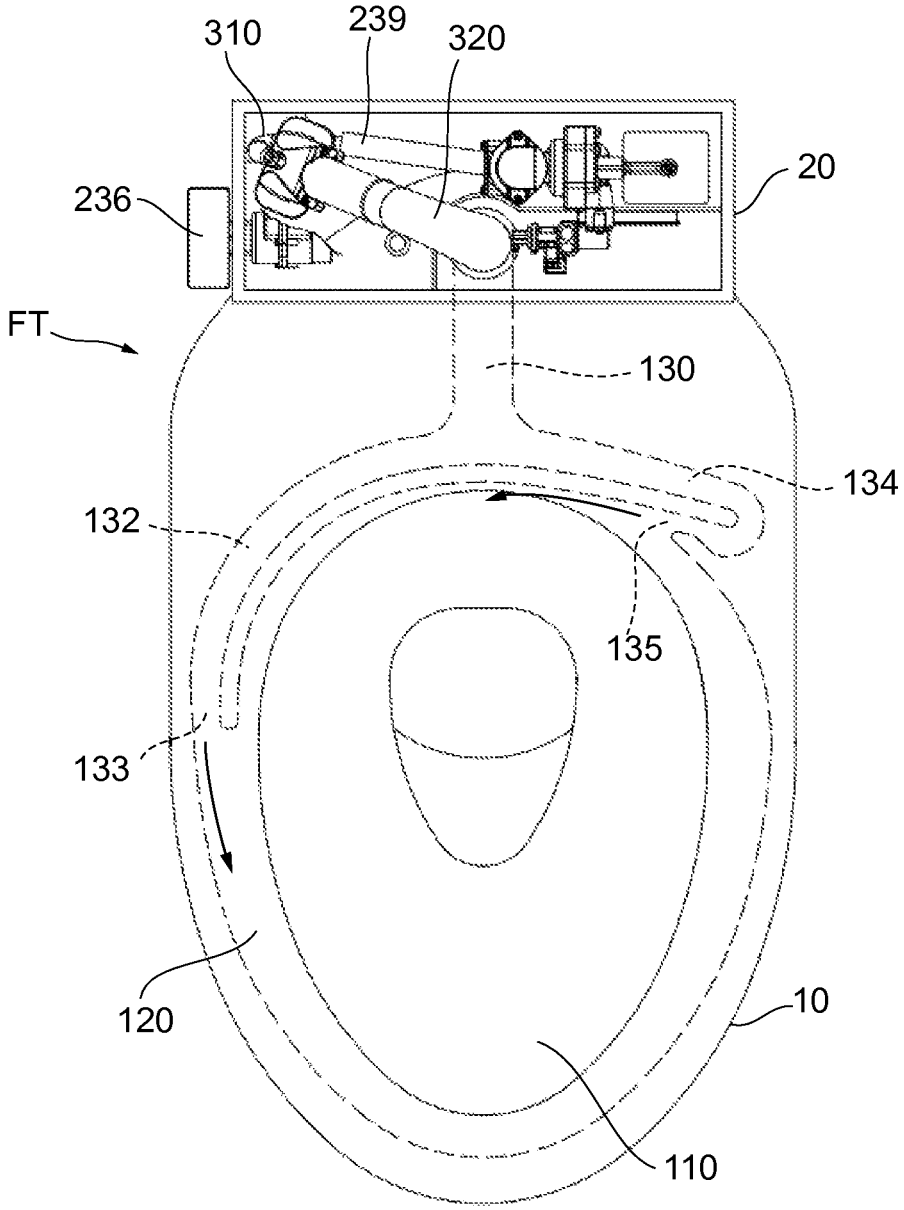
FIG. 2 is a top view of the flush toilet apparatus shown in FIG. 1.

A flush toilet apparatus according to a first embodiment of the present invention will be described with reference to FIGS. 1 and 2. FIG. 1 is a cross-sectional view of a flush toilet apparatus FT, illustrating a cross section when the flush toilet apparatus FT is cut at a surface perpendicular to the left-right direction of the flush toilet apparatus FT. FIG. 2 is a top view of the flush toilet apparatus FT. FIG. 2 depicts a state that an upper lid 201 of a tank 20 is removed in order to show an internal structure of the tank 20 described later.

As shown in FIGS. 1 and 2, the flush toilet apparatus FT includes: a toilet body 10; and the tank 20 installed on an upper surface 101 of the toilet body 10 on a backward side of the toilet body 10 (right side in FIG. 1 and upper side in FIG. 2). The flush toilet apparatus FT is an apparatus in which the toilet body 10 receives waste, and the waste is discharged to a drain pipe SW by water (wash water) supplied from the tank 20.

In the following description, a right side (left side in FIG. 2) as seen from a user seated on the toilet body 10 will be called "right side", and a left side as seen from the user seated on the toilet body 10 will be called "left side" (right side in FIG. 2), unless otherwise stated. A forward side (left side in FIG. 1 and lower side in FIG. 2) as seen from the user seated on the toilet body 10 will be called "front side" or "forward side", and a backward side (right side in FIG. 1 and upper side in FIG. 2) as seen from the user seated on the toilet body 10 will be called "back side" or "backward side".

The toilet body 10 includes a bowl portion 110, a rim portion 120, a water conduit 130, and a drain trap pipeline 140. The bowl portion 110 is a part that temporarily receives the waste falling from above. The rim portion 120 is formed at an upper edge portion of the bowl portion 110, and the rim portion 120 has a shape such that part of an inside surface of the bowl portion 110 is retracted toward a circumference as shown in FIG. 1. As described later, the rim portion 120 is a channel in which water supplied toward the bowl portion 110 circles and flows. The rim portion 120 is formed as a substantially round (when viewed from the top) channel that goes around along the upper edge of the bowl portion 110.

The water conduit 130 is a channel formed inside of the toilet body 10 to guide water supplied from the tank 20 to the bowl portion 110. One end of the water conduit 130 opens into the upper surface 101 of the toilet body 10 to form an inlet 131 of water supplied from the tank 20. The position of the formation of the inlet 131 is at a part on the backward side of the upper surface 101 of the toilet body 10 and is at a center part in the left-right direction.

The water conduit 130 is branched into two channels (first water conduit 132 and second water conduit 134) in the downstream. An end portion on the downstream of the first water conduit 132 as one of the channels opens into a part on the right side of the rim portion 120, and the opening is an outlet 133 of water. When water is supplied from the tank 20 to the inlet 131, part of the water passes through the first water conduit 132, and the water is ejected from the outlet 133 and supplied to the rim portion 120.

An end portion on the downstream of the second water conduit 134 as the other channel opens into a part on the left side of the rim portion 120, closer to the back, and the opening is an outlet 135 of water. When water is supplied from the tank 20 to the inlet 131, part of the water passes through the second water conduit 134, and the water is ejected from the outlet 135 and supplied to the rim portion 120.

The direction of the ejection of water from the outlet 133 is a direction along the circumference of the rim portion 120 formed as a substantially round channel and is a counterclockwise direction when viewed from the top. The direction of the ejection of water from the outlet 135 is also the direction along the circumference of the rim portion 120 formed as a substantially round channel and is the counterclockwise direction when viewed from the top. Therefore, the water ejected from the outlet 133 and the outlet 135 to the rim portion 120 flows down from the entire rim portion 120 toward the bowl portion 110, while circling and flowing counterclockwise along the rim portion 120

The drain trap pipeline 140 is a channel connecting a lower end of the bowl portion 110 and the drain pipe SW. The drain trap pipeline 140 includes: a rising channel 141 forming an uphill grade in a direction from the lower end of the bowl portion 110 toward the downstream; and a falling channel 142 forming a downhill grade in a direction from an upper end of the rising channel 141 toward the downstream. According to the configuration, water can be stored in a part from a lower part of the bowl portion 110 to a lower part of the rising channel 141, and the stored water forms sealing water WT. The drain pipe SW is connected to a lower end of the falling channel 142. The drain pipe SW is a pipe arranged inside of a building, and an end portion on the downstream of the drain pipe SW is connected to a sewer pipe.

When water is supplied from the tank 20 toward the bowl portion 110, the water flows down from the entire rim portion 120 toward the bowl portion 110, while circling and flowing through the rim portion 120, as described above. Water is added from above to the bowl portion 110. The water passes through the rising channel 141 and the falling channel 142 from a lower end portion, and the water is discharged. As a result, there is a downward flow of water (sealing water WT) stored in the bowl portion 110.

The waste temporarily received by the bowl portion 110 is pushed downward by the water supplied from the rim portion 120 above, and the waste moves toward the lower end of the bowl portion 110. Subsequently, the water flow causes the waste to pass through the rising channel 141, and the waste reaches the falling channel 142. The waste falls toward the drain pipe SW along with the water.

The tank 20 is a container storing water inside, and the tank 20 supplies the water to the inlet 131 of the water conduit 130. The tank 20 includes: a first tank portion 210; and a second tank portion 220 formed to extend part of a bottom wall 211 of the first tank portion 210 downward. The first tank portion 210 and the second tank portion 220 are substantially cuboid containers, and internal spaces of the portions are linked to each other. The second tank portion 220 is connected to a part on the backward side of the bottom wall 211 of the first tank portion 210.

The bottom wall 211 of the first tank portion 210 (part on the forward side of the second tank portion 220) is close to and above a part on the backward side of the upper surface 101 of the toilet body 10. Specifically, the inlet 131 is formed at the part on the backward side of the upper surface 101 of the toilet body 10, and the bottom wall 211 of the first tank portion 210 is close to and above the upper surface 101 of the toilet body 10 so as to cover the surrounding of the inlet 131 from the above. An opening 212 in substantially the same shape as the inlet 131 is formed on the bottom wall 211, and the opening 212 and the inlet 131 overlap when viewed from the top. Therefore, the water stored inside of the tank 20 can enter the water conduit 130 through the opening 212 and the inlet 131, and the water can flow toward the bowl portion 110.

As a result of the arrangement of the first tank portion 210, the second tank portion 220 is positioned behind the toilet body 10. More specifically, the second tank portion 220 is positioned on the backward side of the backward end portion of the toilet body 10. A bottom wall 221 of the second tank portion 220 is arranged at a position lower than the upper surface 101 of the toilet body 10.

As a result of the arrangement of the tank 20, a front end portion of the tank 20 is positioned on the forward side of a back end portion of the toilet body 10. A lower end portion of the tank 20 is positioned on the lower side of the upper surface of the toilet body 10. As a result, the dimension in the front-back direction and the dimension in the vertical direction of the entire flush toilet apparatus FT are reduced, and the design of the flush toilet apparatus FT is improved.

Only the second tank portion 220 of the tank 20 is installed on the lower side of the upper surface of the toilet body 10, and a water head of the water stored in the tank 20 is maintained. As a result, performance of a jet pump unit 300 described later (performance of supplying a predetermined amount of water at a predetermined flow rate toward the rim portion 120) is maintained, while downsizing the entire flush toilet apparatus FT as described above.

Figure 3:
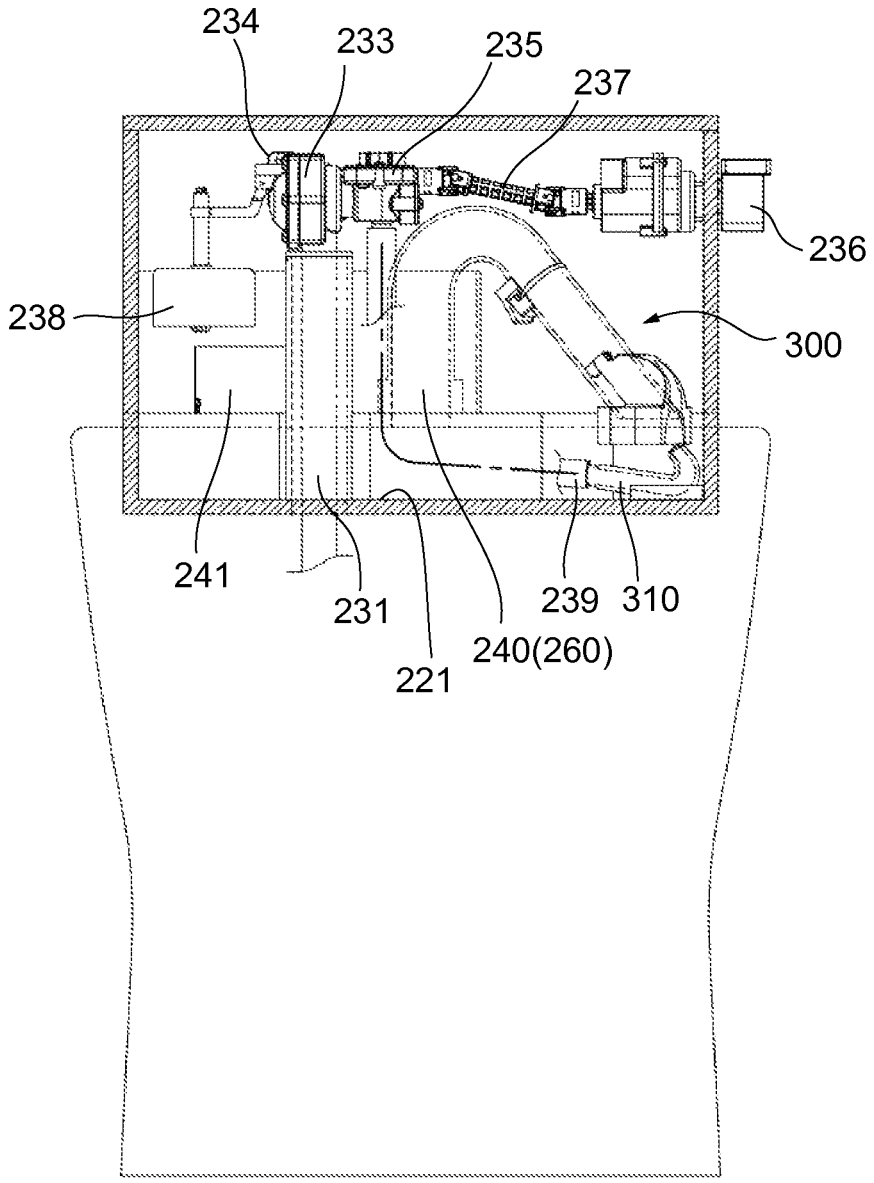
FIG. 3 is a diagram showing inside of a tank of the flush toilet apparatus shown in FIG. 1.
Figure 4:
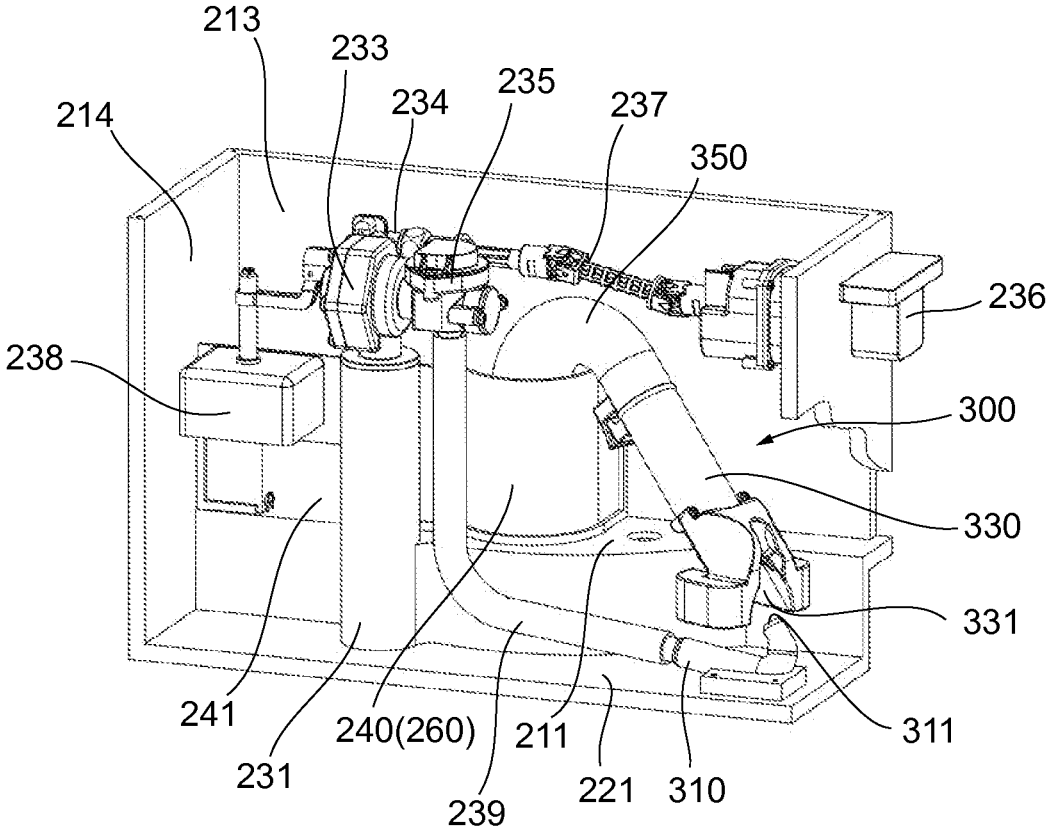
FIG. 4 is a diagram showing inside of the tank of the flush toilet apparatus shown in FIG. 1.

A configuration of the inside of the tank 20 will be described. FIG. 3 is a rear view showing the inside of the tank 20 when the flush toilet apparatus FT is viewed from the backward side. FIG. 4 is a perspective view showing the inside of the tank 20 when the flush toilet apparatus FT is viewed from the backward side. As shown in FIGS. 3 and 4, a water supply pipe 231, a main valve 233, a pilot valve 234, and the jet pump unit 300 are arranged inside of the tank 20.

The water supply pipe 231 is a pipe for supplying water toward the main valve 233 and is arranged to extend vertically upward from the bottom wall 221 of the second tank portion 220. One end of the water supply pipe 231 is connected to a water pipe not shown outside of the tank 20. The other end (upper end) of the water supply pipe 231 is connected to the main valve 233 from below, inside of the tank 20. The water supply pipe 231 is arranged at a position on the left side of the center in the left-right direction of the inside of the tank 20.

A constant flow valve 232 not shown in FIGS. 3 and 4 is arranged in the middle of the water supply pipe 231 (between the water pipe and the main valve 233). When the main valve 233 is open, the flow rate of water entering the main valve 233 is constant because of the constant flow valve 232, and the flow rate is not changed by the water pressure of the water pipe.

The main valve 233 is an open/close valve and is configured to open and close a channel of water from the water supply pipe 231 toward the jet pump unit 300. A vacuum breaker 235 is provided between the main valve 233 and the jet pump unit 300 to prevent the pressure from becoming negative in the upstream of the vacuum breaker 235 which leads to a reverse flow of water. The water supply pipe 231 extends above as described above, and the main valve 233 and the vacuum breakers 235 are arranged at high positions in the tank 20. Therefore, the vacuum breaker 235 is not submerged when the tank 20 is full.

The pilot valve 234 is provided at the main valve 233, and the open/close of the main valve 233 is switched by the operation of the pilot valve 234. A manual lever 236 arranged outside of the tank 20 is connected to the pilot valve 234 through a transmission mechanism 237 arranged inside of the tank 20. A float 238 arranged inside of the tank 20 is further connected to the pilot valve 234.

When the user of the flush toilet apparatus FT operates the manual lever 236, the operation is transmitted to the pilot valve 234 through the transmission mechanism 237, and the pilot valve 234 is opened. As a result, the main valve 233 is opened, and the water flows from the water supply pipe 231 toward the jet pump unit 300. As described later, the water flown toward the jet pump unit 300 is supplied to the water conduit 130 as wash water, along with the water stored inside of the tank 20. Therefore, the water level inside of the tank 20 gradually drops.

The main valve 233 is not closed even after the washing of the bowl portion 110 is finished, and the water continuously flows from the water supply pipe 231 toward the jet pump unit 300. The water flown toward the jet pump unit 300 is supplied inside of the tank 20 and stored for the next washing. When the water toward the inside of the tank 20 is supplied (water is poured into the tank 20), the water level inside of the tank 20 gradually rises. The float 238 connected to the pilot valve 234 inside of the tank 20 rises along with the rise in the water level, and as a result, the pilot valve 234 is closed. More specifically, when the water level inside of the tank 20 rises, the pilot valve 234 is closed by a change in the buoyance received by the float 238. When the pilot valve 234 is closed, the main valve 233 is closed, and the supply of water from the water supply pipe 231 to the jet pump unit 300 is stopped. The arrangement of the float 238 is adjusted so that the amount of water stored inside of the tank 20 at this point is an amount necessary for the next washing (predetermined full water level).

The jet pump unit 300 is configured to induce the jet pump action by the water supplied from the water supply pipe 231 to thereby supply the water toward the water conduit 130. The jet pump unit 300 includes a nozzle 310 and a throat pipe 320.

The nozzle 310 is a pipe in which one end is connected to the vacuum breaker 235 through a connection pipe 239, and an injection port 311 is formed on the other end. The nozzle 310 is arranged near the bottom wall 221 of the second tank portion 220. When the main valve 233 is opened, the water supplied from the water supply pipe 231 flows through the connection pipe 239 to reach the nozzle 310, and a high-speed water flow is injected from the injection port 311. The nozzle 310 is arranged on the backward side of the second tank portion 220, at a corner on the right side (corner when viewed from the top). As shown in FIGS. 3 and 4, the nozzle 310 has a U-shape, and the downstream of the nozzle 310 is folded back from the corner. In the state shown in FIGS. 3 and 4, the injection direction of the injection port 311 faces inside of the throat pipe 320.

The throat pipe 320 is a pipe with a round cross section and is arranged inside of the tank 20, penetrating through the opening 212 formed on the bottom wall 211. One end of the throat pipe 320 is connected to the inlet 131 of the water conduit 130, and a suction port 331, which is an opening, is formed on the other end. A part of the throat pipe 320 closer to the inlet 131 of the water conduit 130 is along the vertical direction, and a part closer to the suction port 331 is inclined relative to the horizontal surface. Therefore, the entire throat pipe 320 has an inverted U-shape. As shown in FIG. 2, the throat pipe 320 is arranged inside of the tank 20, inclined relative to the front-back direction when viewed from the top.

Figure 5:
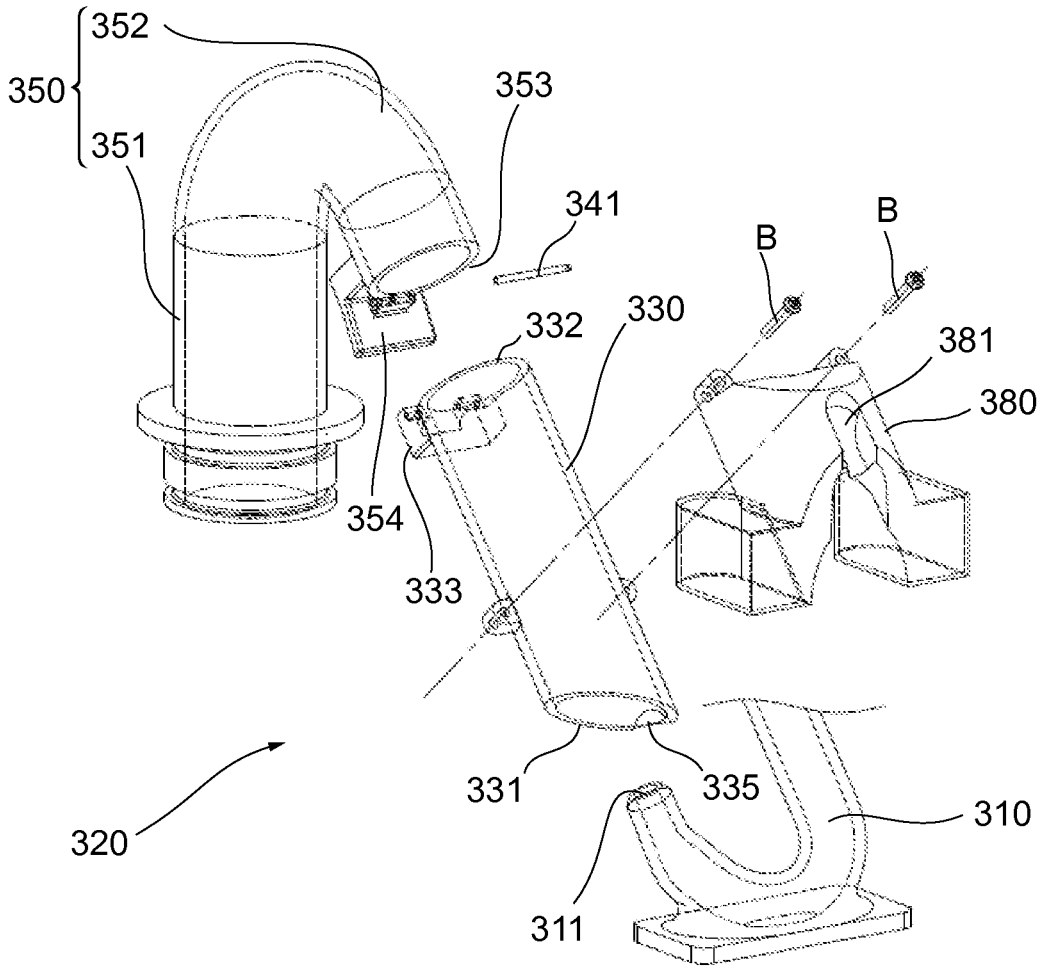
FIG. 5 is an exploded perspective view showing a specific structure of a throat pipe arranged inside of the tank shown in FIG. 3.

A specific configuration of the throat pipe 320 will be described with reference to FIG. 5. FIG. 5 is an exploded perspective view of the throat pipe. As shown in FIG. 5, the throat pipe 320 includes two pipes (first throat pipe 330 and second throat pipe 350) connected in series to form one pipe.

The first throat pipe 330 is a part of the throat pipe 320 closer to the suction port 331 and is a part arranged to incline relative to the horizontal surface as described above. The first throat pipe 330 is a pipe in which the pipe diameter is substantially uniformly cylindrical throughout the entire pipe. The suction port 331, which is an opening, is formed at a lower end of the first throat pipe 330. It can also be stated that the first throat pipe 330 is a part (first linear portion) formed to linearly extend obliquely upward from the suction port 331.

The entire edge of the suction port 331 is formed along a surface inclined relative to a central axis of the first throat pipe 330. In the state shown in FIGS. 3 and 4, the edge of the suction port 331 is along the horizontal surface. More specifically, the edge of the suction port 331 is parallel to the water surface in the tank. Meanwhile, an edge of an opening 332 formed at an upper end of the first throat pipe 330 is along a surface perpendicular to the central axis of the first throat pipe 330. A float 380 is fixed by a bolt B at a lower end portion of the first throat pipe 330 so as to surround the circumference (side surface) of the suction port 331.

The second throat pipe 350 is a part of the throat pipe 320 closer to the water conduit 130. The second throat pipe 350 includes: a vertical portion 351 linearly extending vertically upward from the inlet 131 of the water conduit 130; and a curved portion 352 curved from an upper end of the vertical portion 351 toward the first throat pipe 330. An opening 353 is formed at an end portion of the curved portion 352 closer to the first throat pipe 330. An edge of the opening 353 is along a surface perpendicular to the channel direction of the curved portion 352 at the part.

The vertical portion 351 is a pipe in which the pipe diameter is substantially uniformly cylindrical throughout the entire pipe. It can also be stated that the vertical portion 351 is a part on the downstream of the curved portion 352 and is a part (second linear portion) formed to linearly extend toward the inlet 131 of the water conduit 130 below. The pipe diameter of the vertical portion 351 is greater than the pipe diameter of the first throat pipe 330. The pipe diameter of the curved portion 352 closer to the vertical portion 351 is equal to the pipe diameter of the vertical portion 351. The pipe diameter of the curved portion 352 closer to the first throat pipe 330 is equal to the pipe diameter of the first throat pipe 330. Therefore, the vertical portion 351 and the first throat pipe 330 with different pipe diameters are smoothly connected by the curved portion 352.

As described, the pipe diameter of the first throat pipe 330 is substantially uniform throughout the entire pipe, and the pipe diameter of the vertical portion 351 is also substantially uniform throughout the entire pipe. However, the pipe diameters are not strictly uniform, and the pipe diameters (may also be referred to as channel cross-sectional areas) are formed to gradually and slightly change along the channel. The pipe diameters (channel cross-sectional areas) will be described in detail later.

The first throat pipe 330 and the second throat pipe 350 are connected through a rod-like shaft 341 by combining the opening 332 and the opening 353. The shaft 341 is arranged on the lower side of the opening 332 and the opening 353. The shaft 341 is arranged so that the central axis is horizontal and is perpendicular to the central axis of the first throat pipe 330. The first throat pipe 330 can be rotated and moved relative to the second throat pipe 350, with the shaft 341 as a rotation axis. As the first throat pipe 330 moves as described above, the throat pipe 320 can enter a state in which the opening 332 and the opening 353 are abutted without a gap and a state in which a gap is formed between the opening 332 and the opening 353.

A projection 333 protruding downward is formed on the lower side of the first throat pipe 330, near the opening 332. A plate-like stopper 354 extending toward the lower side of the projection 333 is formed on the lower side of the second throat pipe 350, near the opening 353. A tip of the projection 333 and the stopper 354 are separated in the state in which the opening 332 and the opening 353 are abutted without a gap. Meanwhile, when the gap formed between the opening 332 and the opening 353 is enlarged by rotating the first throat pipe 330 with the shaft 341 as a rotation axis, the tip of the projection 333 comes into touch with an upper surface of the stopper 354, and the first throat pipe 330 cannot be rotated any more.

Figure 6A:
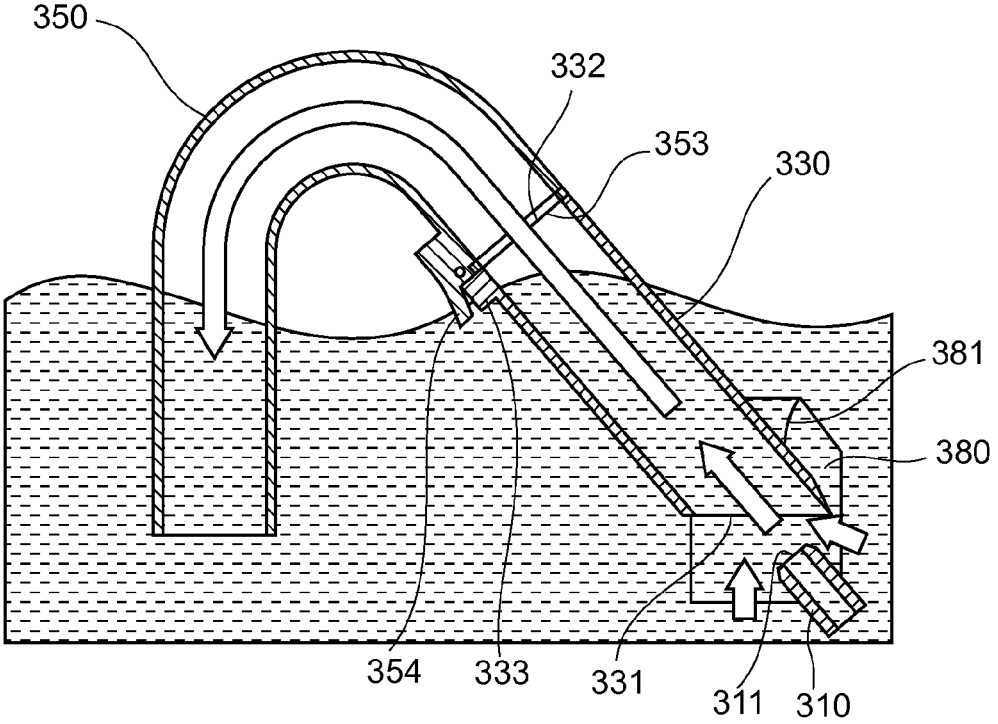
FIGS. 6(A) and 6(B) are cross-sectional views illustrating the operation of the throat pipe shown in FIG. 5.

The operation of the first throat pipe 330 will be further described with reference to FIG. 6. FIG. 6(A) shows a state in which the opening 332 and the opening 353 are abutted without a gap. The position of the first throat pipe 330 in this state will also be called "first position".

When the water level in the tank 20 is the full water level, the entire float 380 fixed to the lower end of the first throat pipe 330 is submerged, and the float 380 receives buoyance. Due to the buoyance, turning force in a direction from a second position to the first position works in the first throat pipe 330. As a result, the first throat pipe 330 is held at the first position.

As shown in FIG. 6(A), when water is injected from the injection port 311 of the nozzle 310 while the first throat pipe 330 is at the first position, the injected high-speed water flows toward the inside of the first throat pipe 330. A part on the lower side of the first throat pipe 330 and the nozzle 310 are submerged inside of the water stored in the tank 20. Therefore, part of the water stored in the tank 20 is drawn inside of the first throat pipe 330 by the high-speed water flow injected from the injection port 311, and the water flows toward the water conduit 130. As a result of the induction of the jet pump action, not only the water injected from the injection port 311 of the nozzle 310, but also the water drawn in from around the suction port 331 flows inside of the first throat pipe 330. The water flows through the water conduit 130 as wash water, and the water is supplied to the rim portion 120.

In this way, the flow rate of water supplied to the rim portion 120 is greater than the flow rate of water injected from the injection port 311 of the nozzle 310 in the flush toilet apparatus FT. In other words, even if the flow rate of water injected from the injection port 311 of the nozzle 310 is small, water at a sufficient flow rate is supplied to the rim portion 120 as wash water. Therefore, even if the flush toilet apparatus FT is installed in an environment with a low water pressure in the water pipe, sufficient washing performance can be exerted.

The total amount of water supplied to the rim portion 120 (and the bowl portion 110) as wash water is equal to a sum of the amount of water stored in advance inside of the tank 20 and the amount of water injected from the injection port 311 of the nozzle 310. Since not all wash water needs to be stored inside of the tank 20, the tank 20 is downsized, and the design is improved.

By the way, water at a part below the suction port 331 of the water stored in the tank 20 is not supplied from the suction port 331 to the inside of the first throat pipe 330. As a result, remained water (can also be referred to as wasteful water) remains inside of the tank 20. However, as shown in FIG. 3, etc., the nozzle 310 and the suction port 331 are arranged inside of the second tank portion 220 (narrow). Therefore, the amount of remained water remaining at the part below the suction port 331 is relatively small.

According to the configuration, the amount of remained water when the supply of water to the rim portion 120 is finished is small in the flush toilet apparatus FT. As a result, most of the internal space of the tank 20 can be used as a space for storing water supplied to the rim portion 120 (water that is not remained water), and the enlargement of the tank 20 is further suppressed.

Although the suction port 331 is arranged inside of the second tank portion 220 in the present embodiment, the suction port 331 may be arranged at a position slightly higher than the upper end of the second tank portion 220 (and at a position overlapping with the second tank portion 220 when viewed from the top). Even in such a case, a large portion of the wasteful water remained on the lower side of the suction port 331 is stored in the second tank portion 220 with a small volume, and the amount of wasteful water can be reduced.

When the wash water is supplied to the rim portion 120, the water level in the tank 20 gradually drops. When the water level drops to near the float 380, the buoyance received by the float 380 is reduced. Therefore, the weight of the first throat pipe 330 causes the first throat pipe 330 to rotate with the shaft 341 as a rotation axis, and the first throat pipe 330 moves downward.

Figure 6B:
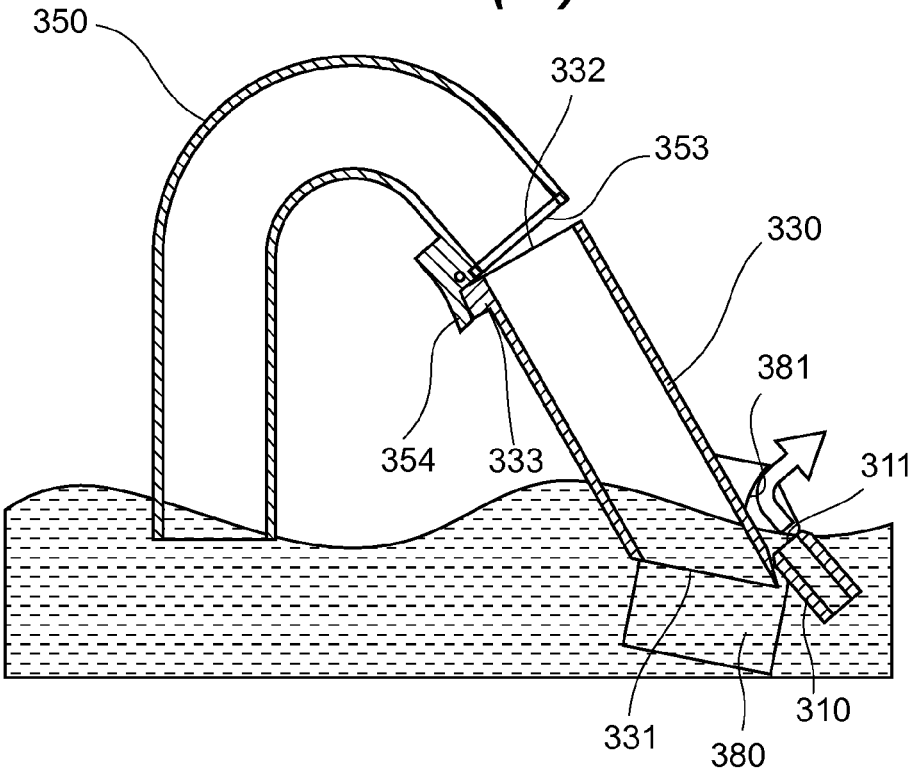

FIG. 6(B) shows a state in which the first throat pipe 330 rotates with the shaft 341 as a rotation axis from the state of FIG. 6(A), and the tip of the projection 333 comes into touch with the upper surface of the stopper 354. In other words, a state that the gap formed between the opening 332 and the opening 353 is the largest is illustrated. The position of the first throat pipe 330 in this state will also be called "second position".

As shown in FIG. 6(B), when water is injected from the injection port 311 of the nozzle 310 while the first throat pipe 330 is at the second position, the injected high-speed water misses the suction port 331, and the water is not supplied inside of the first throat pipe 330. The water injected from the injection port 311 is supplied inside of the tank 20 (around the first throat pipe 330) and stored in the tank 20.

When the position of the first throat pipe 330 is switched from the first position to the second position while the water is injected from the injection port 311 of the nozzle 310, the supply of water to the rim portion 120 is stopped, and the water is started to be poured into the tank 20. In this way, part of the throat pipe 320 can be moved inside of the tank 20 in the flush toilet apparatus FT to switch (hereinafter, also called "channel switching") the state that the water is supplied to the rim portion 120 (bowl portion 110) and the state that water is poured into the tank 20. In other words, the throat pipe 320 functions as a channel switching valve for switching the supply destination of water injected from the injection port 311 of the nozzle 310. A mechanism element, such as a valve for switching the channel, does not have to be separately arranged inside of the tank 20, and the enlargement of the tank 20 is suppressed.

An inclined surface 381 formed to rise from the upper surface of the first throat pipe 330 is formed at a part of the float 380 positioned on the upper side of the first throat pipe 330 (see FIGS. 5 and 6). The inclined surface 381 is a surface inclined relative to the central axis of the first throat pipe 330, and the width is slightly larger than the internal diameter of the injection port 311. As shown in FIG. 6(B), after the movement of the first throat pipe 330 to the second position, the water injected from the injection port 311 comes into touch with the inclined surface 381, and the flow direction is changed upward.

As the water injected from the injection port 311 comes into touch, the inclined surface 381 receives downward force. In other words, the inclined surface 381 receives the downward force as a reaction of changing the flow direction of the water injected from the injection port 311 upward. As a result, turning force in a direction from the first position to the second position is applied to the first throat pipe 330. The first throat pipe 330 is held at the second position due to the turning force.

After that, the water injected from the injection port 311 is continuously supplied to the tank 20. The water level in the tank 20 rises, and the float 380 is submerged again. However, the first throat pipe 330 is continuously held at the second position by the turning force during the injection of water from the injection port 311. When the water level in the tank 20 rises and reaches the full water level, the pilot valve 234 and the main valve 233 are closed as already described, and the supply of water from the water supply pipe 231 to the jet pump unit 300 is stopped. The injection of water from the injection port 311 is stopped, and the first throat pipe 330 returns to the first position by the buoyance received by the float 380. The flush toilet apparatus FT enters a standby state.

Another configuration inside of the tank 20 will be described with reference again to FIG. 4. As shown in FIG. 4, a partition wall 240 surrounding the vertical portion 351 of the throat pipe 320 is arranged inside of the tank 20. The partition wall 240 is formed to extend upward from the bottom wall 211. Part of the internal space of the tank 20 is divided by the partition wall 240, a front wall surface 213 of the tank 20, a left wall surface 214, and the bottom wall 211 of the first tank portion 210, and a small tank 260 is formed. The small tank 260 is a container in which an upper part opens inside of the tank 20 and is arranged on the forward side of the first tank portion 210, at a corner on the left side. As for the throat pipe 320, a lower end part of the vertical portion 351 is arranged inside of the small tank 260. The suction port 331 is arranged outside of the small tank 260.

An open/close window 241 is provided near a lower end portion of the partition wall 240. The open/close window 241 is usually open, and the inside and the outside (space on the backward side of the partition wall 240) of the small tank 260 are linked through the open/close window 241. Therefore, in a state that the bowl portion 110 is not washed (standby state), the water level of the water stored in the tank 20 and the water level of the water stored in the small tank 260 are equal.

The manual lever 236 can be operated in two directions (large direction and small direction). When the manual lever 236 is operated in the large direction, the pilot valve 234 and the main valve 233 are opened, while the open/close window 241 stays open. The water stored in the small tank 260 passes through the open/close window 241 and flows out to the second tank portion 220 to reach the suction port 331. Therefore, most of the water stored inside of the tank 20 including the water stored in the small tank 260 is drawn inside of the throat pipe 320 and supplied to the rim portion 120.

Meanwhile, when the manual lever 236 is operated in the small direction, the open/close window 241 is closed, and at the same time, the pilot valve 234 and the main valve 233 are opened. Therefore, of the water stored inside of the tank 20, the water stored in the small tank 260 cannot pass through the open/close window 241 and remains inside of the small tank 260. As a result, the amount of water supplied to the rim portion 120 as wash water is small.

In the following description, "the water level of the water stored in the tank 20", "the water level in the tank 20", or the like denotes the water level outside of the small tank 260. More specifically, this denotes the water level of the water stored in the space where the suction port 331 is arranged, of the two spaces divided by the partition wall 240. The water level of the water stored in the small tank 260 will not be taken into account in the following description.

Figure 7:
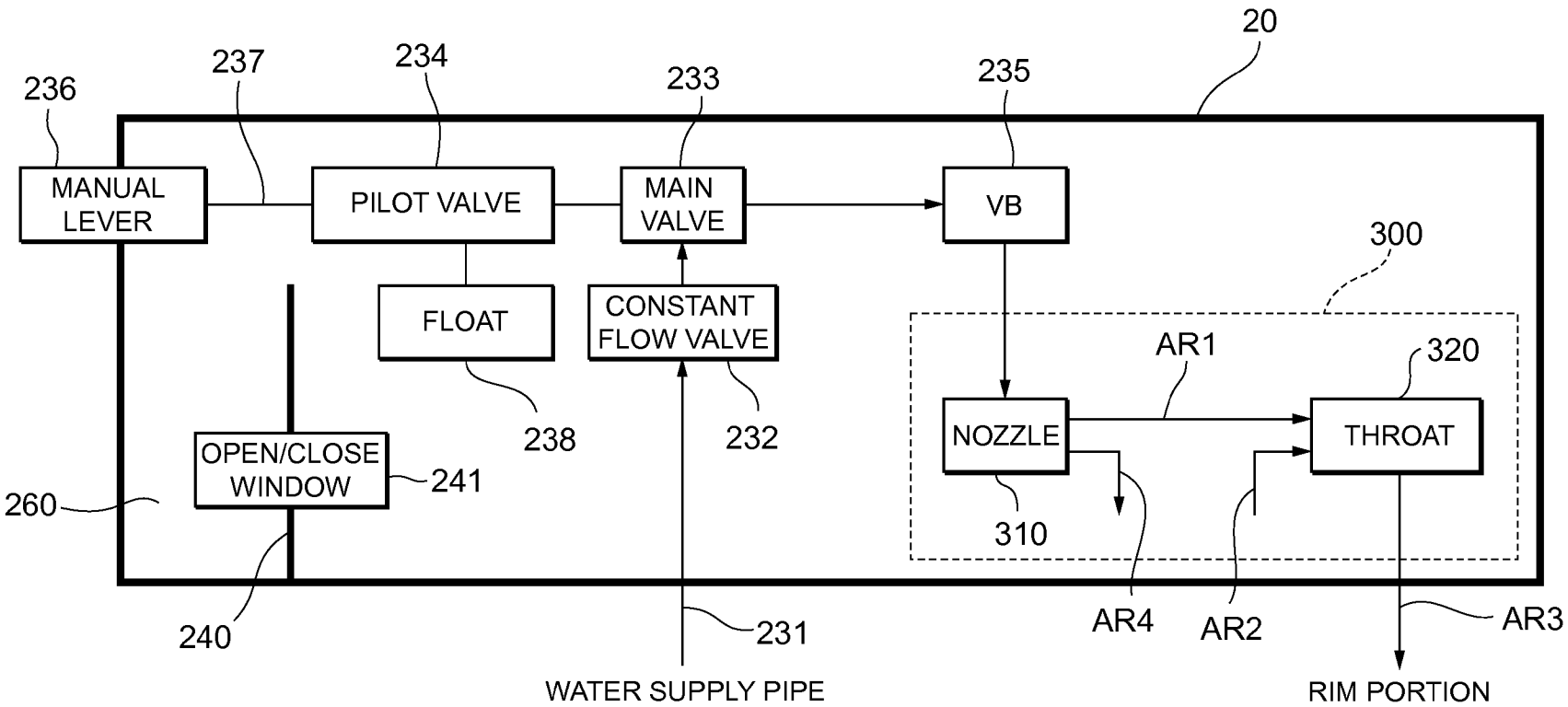
FIG. 7 is a diagram showing a configuration inside of the tank of the flush toilet apparatus shown in FIG. 1.

FIG. 7 schematically shows a configuration inside of the tank 20. As already described, the water supply pipe 231, the main valve 233, the pilot valve 234, the small tank 260, and the jet pump unit 300 are arranged inside of the tank 20.

In the state that the bowl portion 110 is not washed (standby state), the water level of the tank 20 is the full water level, and the first throat pipe 330 is at the first position. When the user of the flush toilet apparatus FT operates the manual lever 236, the main valve 233 is opened, and water is injected from the injection port 311 of the nozzle 310 as already described (arrow AR1 of FIG. 7). The water stored inside of the tank 20 is drawn inside of the throat pipe 320 (arrow AR2 of FIG. 7) and supplied to the rim portion 120 as wash water (arrow AR3 of FIG. 7).

When the supply of water to the rim portion 120 is finished, the position of the first throat pipe 330 is switched from the first position to the second position, and the water is started to be poured into the tank 20 (arrow AR4 of FIG.

7). The water level in the tank 20 gradually rises, and the pilot valve 234 is closed by the float 238 at the full water level. At the same time, the main valve 233 is closed, and the pouring of water into the tank 20 is finished. The state returns to the standby state.

In this way, since the jet pump action is used to supply water to the toilet body 10 in the flush toilet apparatus FT according to the present embodiment, the tank 20 is downsized. As a result, the time required to pour water into the tank 20 is short, and continuous washing is substantially possible.

A specific shape of the throat pipe 320 and arrangement in the tank 20 will be further described. As shown in FIGS. 1, 2, 3, 4, etc., the central axis of the first throat pipe 330 is inclined relative to the front-back direction when viewed from the top and is also inclined relative to the horizontal surface when viewed from the back. This ensures the maximum channel length of the first throat pipe 330 in the limited space of the tank 20. In other words, this ensures the maximum length of the linear channel as a part on the upstream of the throat pipe 320 (channel on the upstream of the curved portion 352).

Therefore, the distribution of the flow velocity in the channel cross section of the water flowing inside of the first throat pipe 330 toward the second throat pipe 350 is equalized before the water reaches the curved portion 352. As a result, when the water reaches the curved portion 352, the generation of a flow detached from the channel wall surface and the generation of stagnation and vortexes inside of the curved portion 352 are suppressed. The reduction in the performance of the jet pump caused by the shape of the throat pipe 320 is suppressed, and a smooth water flow is ensured inside of the throat pipe 320. The relationship between the length of the first throat pipe 330 and the flow velocity distribution of the water flow will be described in detail later.

As is clear from FIG. 1, etc., the throat pipe 320 is arranged in the tank 20 so that the angle (0 degrees in the present embodiment) between the central axis of the vertical portion 351 (second linear portion) and the vertical direction is smaller than the angle between the central axis of the first throat pipe 330 (first linear portion) and the vertical direction.

According to the configuration, as for the length in the front-back direction, the length of the first throat pipe 330 (first linear portion) is longer than the length of the vertical portion 351 (second linear portion). Therefore, a large portion of the limited space in the tank 20 is effectively used as a space for ensuring the length of the first throat pipe 330 necessary to efficiently generate the jet pump action. More specifically, while the entire throat pipe 320 is arranged in the small tank 20, a sufficient length of the first throat pipe 330 (first linear portion) is ensured.

Therefore, the distribution of the flow velocity in the channel cross section of the water flowing inside of the first throat pipe 330 is sufficiently equalized before the water reaches the curved portion 352, and this suppresses the generation of stagnation and vortexes inside of the throat pipe 320 and prevents the inner surface of the throat pipe 320 from interfering with a local high-speed water flow. As a result, the resistance faced by the water flow in the throat pipe 320 is suppressed, and the reduction in the efficiency of the jet pump action is suppressed. The flow rate can be efficiently increased to supply water to the water conduit 130.

As already described, the suction port 331 is arranged inside of the second tank portion 220. As a result, the suction port 331 as the lower end of the first throat pipe 330 is arranged at a position overlapping with the second tank portion 220 when viewed from the top. In other words, part of the bottom wall of the tank 20 has a shape extending downward on the lower side of the suction port 331.

According to the configuration, the suction port 331 can be arranged further downward to ensure the length of the first throat pipe 330 (first linear portion) further sufficiently. Although the nozzle 310 is arranged in the space on the lower side of the suction port 331 in the tank 20, the inside of the second tank portion 220 is used as a space for the arrangement. In other words, the first throat pipe 330 (first linear portion) does not have to be shortened to arrange the nozzle below the suction port 331.

Although the suction port 331 is arranged inside of the second tank portion 220 in the present embodiment, the suction port 331 may be arranged at a position higher than the upper end of the second tank portion 220. Even in this case, it is desirable to arrange the suction port 331 at a position overlapping with the second tank portion 220 when viewed from the top.

As shown in FIG. 6(A), the suction port 331 is formed so that the entire edge of the suction port 331 is along the horizontal surface when the first throat pipe 330 is at the first position. It can be stated that the suction port 331 with the edge in such a shape is an opening formed when the end portion of the throat pipe 320 is cut along the horizontal surface.

Since the height of the upper end of the edge and the height of the lower end of the edge are the same in the suction port 331 formed this way, there is no space between the upper end of the edge and the lower end of the edge, i.e., a space that stores wasteful water despite the fact that the nozzle 310 cannot be arranged. Therefore, the first throat pipe 330 can be extended downward so that the upper end of the suction port 331 approaches close to the nozzle 310. As a result, although the tank 20 is downsized, a large portion of the water stored in the tank 20 can be effectively used as wash water (amount of wasteful water can be reduced) to sufficiently ensure the generation time of the jet pump action, and high washing performance can be exerted.

The formation of the suction port 331 can lower the water level of the water stored inside of the tank 20 to near the suction port 331, while preventing air from entering inside of the throat pipe 320 from the suction port 331. Since the water stored inside of the tank 20 is used without waste, the tank 20 can be further downsized.

Figure 8:
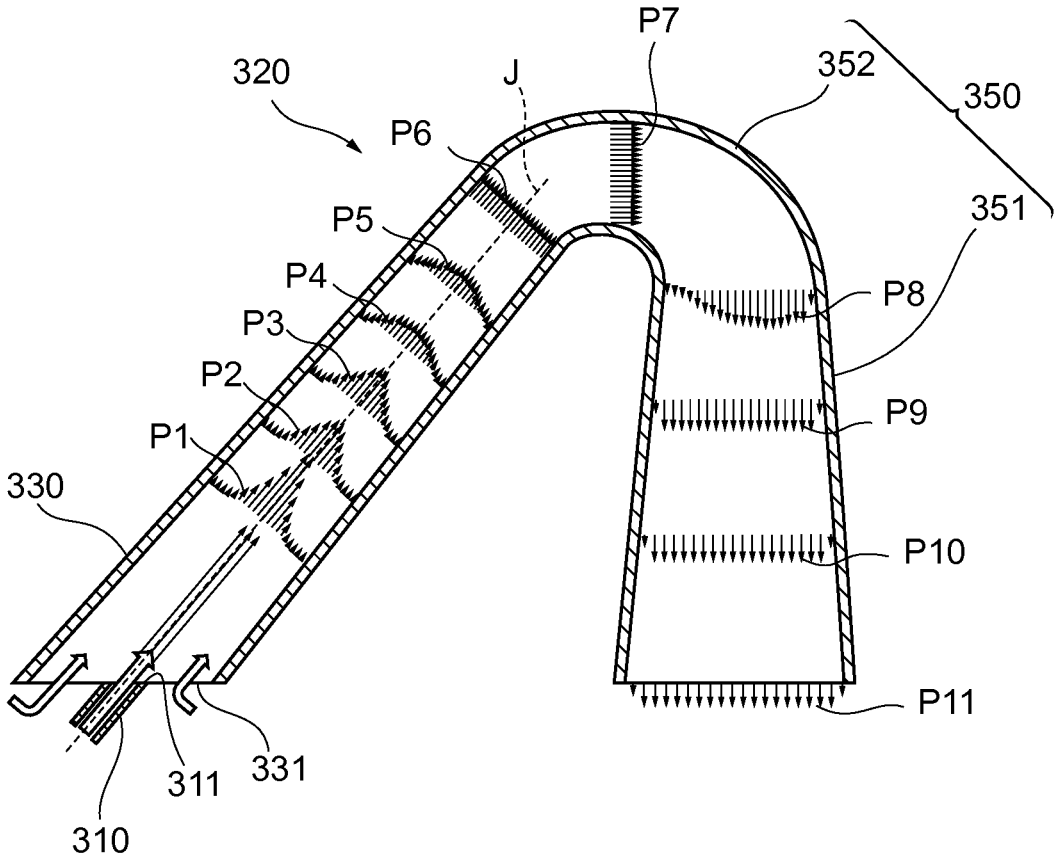
FIG. 8 is a diagram schematically showing a shape of the throat pipe and a distribution of flow velocity of a water flow inside of the throat pipe.

FIG. 8 is a diagram schematically showing the shape of the throat pipe 320 and the distribution of the flow velocity of the water flow inside of the throat pipe 320. As already described, although the pipe diameter of the first throat pipe 330 is substantially uniform throughout the entire pipe, the pipe diameter is not strictly uniform, and the pipe diameter (may be referred to as channel cross-sectional area) slightly changes along the channel. Specifically, the pipe diameter is the widest at the suction port 331 that is the upstream end, and the pipe diameter gradually narrows down toward the downstream. The change in the pipe diameter is smooth. The entire inner wall surface of the first throat pipe 330 is smooth, and a corner or the like is not formed.

The same applies to the vertical portion 351 of the second throat pipe 350. The pipe diameter of the vertical portion 351 is not strictly uniform, and the pipe diameter slightly changes along the channel. Specifically, the pipe diameter is the narrowest at a portion of connection with the curved portion 352 (upstream end of the vertical portion 351), and the pipe diameter gradually widens toward the downstream.

The change in the pipe diameter is smooth. The entire inner wall surface of the second throat pipe 350 is smooth, and a corner or the like is not formed. The entire inner wall surface of the entire throat pipe 320 is also smooth, and a corner or the like is not formed.

FIG. 8 depicts that the pipe diameter of the first throat pipe 330 narrows down toward the downstream and that the pipe diameter of the vertical portion 351 widens toward the downstream, in an exaggerated manner than in reality.

FIG. 8 shows a state in which water is injected from the injection port 311, and the water flows inside of the throat pipe 320 toward the water conduit 130. The flow velocity distributions in the channel cross sections of eleven locations of the throat pipe 320 (position P1, position P2, . . . position P11 in order from the upstream) are schematically illustrated by arrows.

As shown in FIG. 8, the flow velocities of areas (jet flow internal areas) near a central axis J (central axis of the injected water flow) of the channel cross section at the position P1 near the suction port 331 of the first throat pipe 330 are large due to the influence of the jet flow from the injection port 311. On the other hand, the flow velocities in areas far from the central axis J of the channel cross section (areas near the inner walls of the first throat pipe 330: jet flow external areas) are smaller than those of the areas near the central axis J, because the influence of the jet flow from the injection port 311 is relatively small. In this way, a high-speed water flow is unevenly distributed to part of the areas of the channel cross section (areas near the central axis J).

At a jet flow periphery section (boundary part between the jet flow internal areas and the jet flow external areas), liquids inside and outside of the jet flow are mixed by vortexes generated by the velocity difference between the inside and the outside of the jet flow. As a result, the flow rate of the internal liquid conveyed by the jet flow increases toward the downstream by gradually taking in the external liquid (jet pump action). In other words, the momentum is transferred between liquid elements inside and outside of the jet flow in the jet flow periphery sections. The external liquid receives the momentum from the internal liquid to accelerate, and the external liquid is taken inside of the jet flow. The internal liquid transfers the momentum to the external liquid, and the internal liquid decelerates. Therefore, the flow velocity distribution of the water in the channel cross section is gradually equalized, while the water flows through the first throat pipe 330 (linear channel). As shown by the arrows at the positions P1 to P5 in FIG. 8, the difference between the flow velocity of water in the area near the central axis J (maximum flow velocity) and the flow velocity of water in the area near the inner wall of the first throat pipe 330 (minimum flow velocity) is smaller toward the downstream. As a result, as shown by the arrows at the position P6, the flow velocity distribution of the water that has reached the curved portion 352 is substantially equalized throughout the channel cross section.

As can be understood from the foregoing description, if the length of the first throat pipe 330 (linear channel) is not sufficient, the water flowing through the first throat pipe 330 reaches the curved portion 352, while the flow velocity distribution is not equalized (high-speed water flow is unevenly distributed to part of the areas). In this case, the local high-speed water flow that has reached the curved portion 352 detaches from the inner wall of the internal circumference of the curved portion 352, and this generates stagnation and vortexes in which the water flow stays. If the stagnation and vortexes are generated in the water flow, the energy is wastefully consumed in the stagnation area, and the flow rate of water supplied to the toilet body 10 is reduced. As a result, the waste may not be discharged from the bowl portion 110, or the surface of the bowl portion 110 may not be sufficiently washed.

If the length of the first throat pipe 330 is not sufficient, the distance from the injection port 311 to the curved portion 352 is short. Therefore, the flow of water injected from the injection port 311 (local high-speed jet flow) comes into touch with the inner surface of the curved portion 352 (interferes with the water flow). This increases the pressure around the downstream of the first throat pipe 330, and the pressure rapidly rises (pressure gradient is steep) toward the curved portion 352. This generates a reverse flow in part of the inside of the first throat pipe 330 and generates stagnation and vortexes in which the water flow stays in the first throat pipe 330. If the stagnation and vortexes are generated in the first throat pipe 330, the energy is wastefully consumed in the stagnation area. The jet pump action of drawing the external liquid inside of the jet flow is suppressed, and the flow rate of water supplied to the toilet body 10 is further reduced.

Therefore, the length of the first throat pipe 330 is sufficiently ensured in the present embodiment to suppress the formation of the stagnation and vortexes in the water flow in the throat pipe 320 as well as the interference of the inner surface of the throat pipe 320 and to suppress the reduction in the flow rate of water supplied to the toilet body 10.

Furthermore, the channel cross-sectional area of the first throat pipe 330 of the present embodiment is greater in the upstream than in the downstream as described above, and the area of the opening of the suction port 331 is relatively large. Therefore, a large amount of water can be sucked inside from the suction port 331. As a result, the jet pump action can be highly efficiently generated, and a large amount of wash water can be supplied to the toilet body 10.

Since the channel cross-sectional area in the downstream of the first throat pipe 330 is small, the flow velocity distribution in the channel cross section of water flowing through the first throat pipe 330 becomes uniform while the water flows for a relatively short distance. More specifically, the flow velocity distribution in the channel cross section is surely equalized before the water reaches the curved portion 352. This can further suppress the generation of vortexes inside of the first throat pipe 330 and the interference with the local high-speed water flow by the inner wall surface of the first throat pipe 330.

The channel cross-sectional areas from the first throat pipe 330 to the curved portion 352 are designed by taking into account the equalization of the flow velocity distribution as described above. As a result, the channel cross-sectional area at the downstream end portion of the curved portion 352 and the channel cross-sectional area at the upstream end portion of the water conduit 130 do not usually match (the latter is greater in the present embodiment). Therefore, the shape of the vertical portion 351 is devised in the present embodiment to smoothly connect the curved portion 352 and the water conduit 130. Specifically, the channel cross-sectional area of the vertical portion 351 is gradually changed (enlarged) from the upstream to the downstream. The entire inner wall surface of the vertical portion 351 is smooth, and a corner or the like is not formed. Therefore, the detachment of the water flow or the stagnation and vortexes are not generated inside of the vertical portion 351. As shown by the arrows at the positions P8 to P11 in FIG. 8, the water flows inside of the vertical portion 351, while the flow velocity distribution in the channel cross section remains to be substantially uniform. As a result, the reduction in the efficiency of the jet pump action in the throat pipe 320 is further suppressed.

Subsequently, various measures for downsizing the tank 20 will be described. In the flush toilet apparatus FT, the part (first throat pipe 330) closer to the suction port 331 of the throat pipe 320 is inclined when viewed from the top and when viewed from the side and is arranged inside of the tank 20. Specifically, the part is inclined to descent toward the suction port 331 when viewed from the side. When viewed from the top, the part is inclined relative to the front-back direction.

The arrangement of the throat pipe 320 in the tank in this state ensures the channel length (substantially linear) necessary for efficient generation of the jet pump action, without enlarging the tank 20. In this way, the arrangement of the throat pipe 320 is devised in the flush toilet apparatus FT to downsize the tank without sacrificing the performance of the jet pump unit 300.

Figure 9:
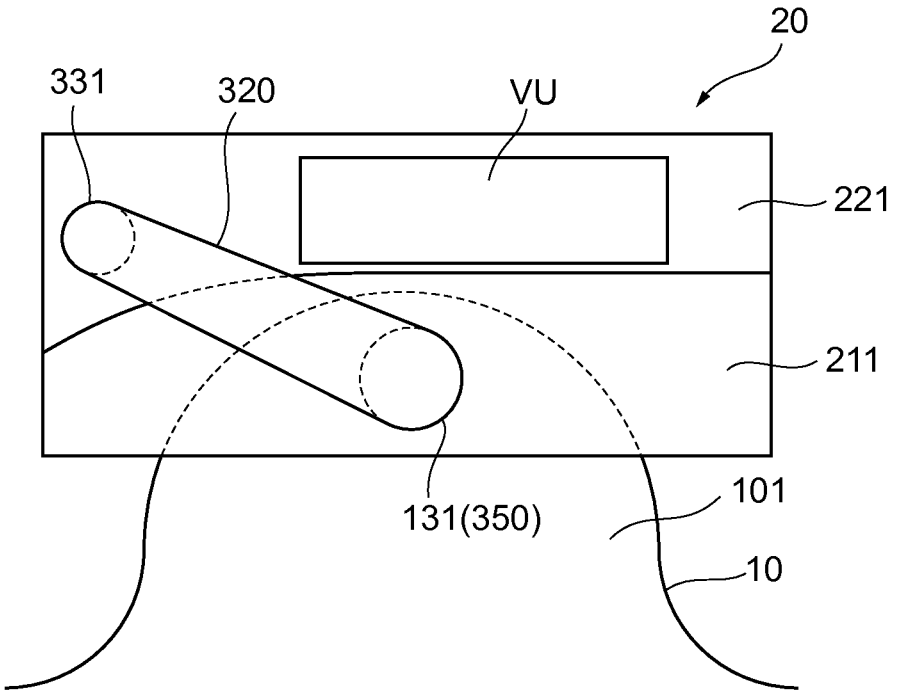
FIG. 9 is a top view showing a positional relationship between a suction port of the throat pipe and a toilet body.

FIG. 9 is a top view showing a positional relationship between the suction port 331 and the toilet body 10, schematically showing the arrangement of the throat pipe 320 inside of the tank 20 when viewed from the top. In FIG. 9, a reference sign VU denotes a group of devices including the water supply pipe 231, the constant flow valve 232, the main valve 233, the pilot valve 234, and the vacuum breaker 235. Hereinafter, the devices will be described as a valve unit VU.

As shown in FIG. 9, the suction port 331 is arranged at a position not overlapping with the toilet body 10 when viewed from the top. Although the nozzle 310 (not shown in FIG. 9) and the bottom wall 221 of the second tank portion 220 exist below the suction port 331, the toilet body 10 does not exist further below. Therefore, the shape of the part of the bottom wall 221 below the nozzle is not restricted by the toilet body 10, and an appropriate shape for arranging the nozzle 310 is possible. For example, in the present embodiment, part of the tank 20 is extended downward so that the position of the bottom wall 221 is lower than the upper surface 101 of the toilet body 10. In this way, the nozzle 310 is arranged by ensuring a wide space between the suction port 331 and the bottom wall 221, without raising the position of the upper end of the tank 20. As a result, the enlargement of the tank 20 is suppressed. Furthermore, the lower end (suction port 331) of the first throat pipe 330 is arranged inside of the second tank portion 220 to ensure the channel length of the first throat pipe 330. This configuration can also improve the performance of the jet pump unit 300.

As shown in FIG. 9, the valve unit VU is arranged across a space on the opposite side (left side) of the side (right side) where the suction port 331 is arranged in the left-right direction and a space on the backward side of the second throat pipe 350, in the tank 20. In other words, the valve unit VU is arranged at a position not interfering with the suction port 331, while effectively using the space (space on the backward side of the second throat pipe 350) widely available as a result of the arrangement of the throat pipe 320 inclined when viewed from the top. Therefore, although the valve unit VU is arranged in the tank 20, the enlargement of the tank 20 is suppressed.

As described with reference to FIG. 4, the small tank 260 is arranged on the forward side of the first tank portion 210, at the corner on the left side. In other words, the small tank 260 is arranged inside of the tank 20 at a part on the opposite side (left side) of the side (right side) where the suction port 331 is arranged in the left-right direction. Furthermore, the small tank 260 and the valve unit VU (main valve 233, etc.) are lined up in the front-back direction. The small tank 260 and the valve unit VU are arranged, while effectively using the space in the tank 20 other than the part occupied by the throat pipe 320. Therefore, although the devices are arranged in the tank, the enlargement of the tank 20 is suppressed.

As described with reference to FIG. 4, the transmission mechanism 237 is arranged inside of the tank 20. The transmission mechanism 237 is arranged above the first throat pipe 330 inside of the tank 20. In other words, the space formed by arranging the first throat pipe 330 inclined relative to the horizontal surface is effectively used as a space for arranging the transmission mechanism 237. Therefore, although the transmission mechanism 237 is arranged in the tank 20, the enlargement of the tank 20 is suppressed.

In place of the transmission mechanism 237 or along with the transmission mechanism 237, part or all of the devices forming the valve unit VU may be arranged above the first throat pipe 330. The valve unit VU includes the vacuum breaker 235 as described above. The transmission mechanism 237 also includes an electric motor in some cases. Therefore, the valve unit VU and the transmission mechanism 237 often need to be arranged at positions not submerged in the tank 20. In this regard, at least part of the space formed above the first throat pipe 330 is a space not submerged even when the tank 20 is at the full water level. Therefore, there is no trouble by the submergence even if the valve unit VU and the transmission mechanism 237 are arranged in the space.

As shown in FIG. 4, the bottom wall 211 of the first tank portion 210 (part on the forward side of the second tank portion 220) is horizontal in the present embodiment. In place of such a mode, the bottom wall 211 (upper surface of the bottom wall 211) may be inclined to descend toward the second tank portion. In this case, the water inside of the first tank portion 210 smoothly and surely flows into the second tank portion 220 in the process of the reduction in the water level of the water stored inside of the tank 20. This can prevent the water from staying on the upper surface of the bottom wall 211 and can prevent the reduction of the water surface WS below the suction port 331. Therefore, the generation of noise caused by the air entering inside of the throat pipe 320 from the suction port 331 can be further suppressed.

Figure 10:
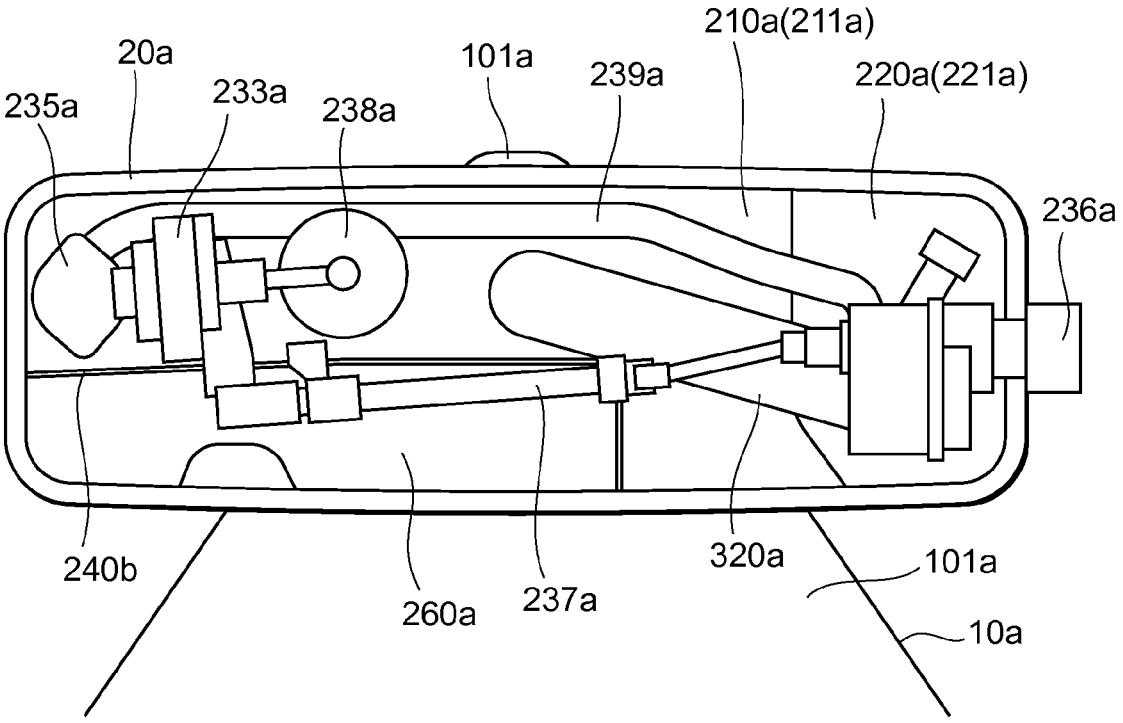
FIG. 10 is a top view showing a configuration and the like inside of a tank of a flush toilet apparatus according to a second embodiment of the present invention.
Figure 11:
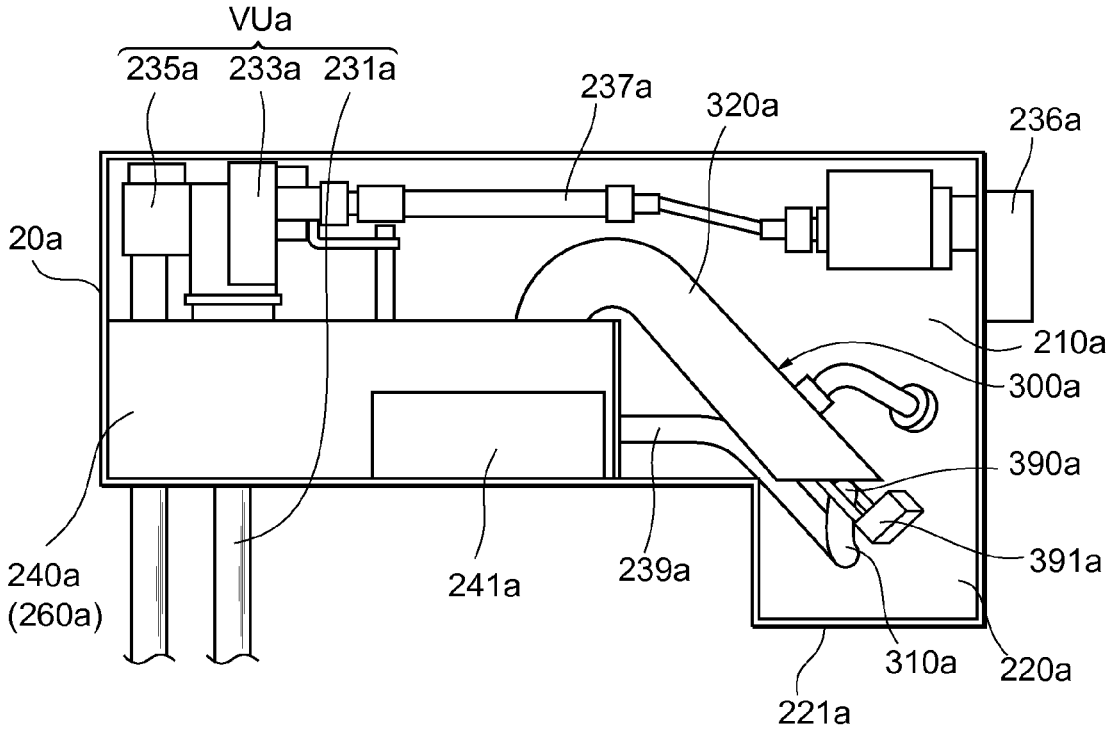
FIG. 11 is a front view showing a configuration inside of the tank of the flush toilet apparatus shown in FIG. 10.

Subsequently, a flush toilet apparatus FTa according to a second embodiment of the present invention will be described. FIG. 10 is a top view showing a configuration inside of a tank 20*a* of the flush toilet apparatus FTa and a configuration around the tank 20*a*. FIG. 11 is a front view showing a configuration inside of the tank 20*a*.

In the flush toilet apparatus FTa, the shape of the tank 20*a* and the arrangement of a valve unit VUa and the like inside of the tank 20*a* are mainly different from the flush toilet apparatus FT, and the other parts have substantially the same configurations as those of the flush toilet apparatus FT. Hereinafter, differences from the flush toilet apparatus FT will be described.

The dimension of the tank 20*a* in the front-back direction is shorter than the tank 20 in the first embodiment. As shown in FIG. 10, a backward end portion of the tank 20*a* arranged on a backward upper part of a toilet body 10*a* (part on the backward side of an upper surface 101*a*) is positioned on the forward side of the backward end portion of the toilet body 10*a*. Therefore, the entire dimension of the flush toilet apparatus FTa in the front-back direction is not enlarged by arranging the tank 20*a*.

The dimension (width) of the tank 20*a* in the left-right direction is greater than the width of the part where the tank 20*a* is arranged on the upper surface 101*a* of the toilet body 10*a*. The tank 20*a* horizontally protrudes from the toilet body 10*a* and includes parts not overlapping with the toilet body 10*a* on the left and right when viewed from the top.

The tank 20*a* includes: a first tank portion 210*a*; and a second tank portion 220*a* formed so as to extend part of a bottom wall 211*a* of the first tank portion 210*a* downward. The first tank portion 210*a* and the second tank portion 220*a* are substantially cuboid containers, and internal spaces of the portions are linked to each other.

As shown in FIGS. 10 and 11, the second tank portion 220*a* in the present embodiment is formed only on a part on the lower side and the left side of the tank 20*a*. Specifically, of the bottom wall 211*a* of the first tank portion 210*a*, only a part that is not overlapping with the toilet body 10*a* when viewed from the top and that protrudes to the left side from the toilet body 10*a* is formed to extend downward.

A nozzle 310*a* is arranged inside of the second tank portion 220*a* formed as described above. A suction port 331*a* as an upstream end portion (lower end) of a throat pipe 320*a* is arranged above the nozzle 310*a* and arranged at a position where the entire suction port 331*a* overlaps with the second tank portion 220*a* when viewed from the top. In other words, it can also be stated that at least part of the second tank portion 220*a* is formed at a position overlapping with the suction port 331*a* of the throat pipe 320*a* when viewed from the top.

Figure 12:
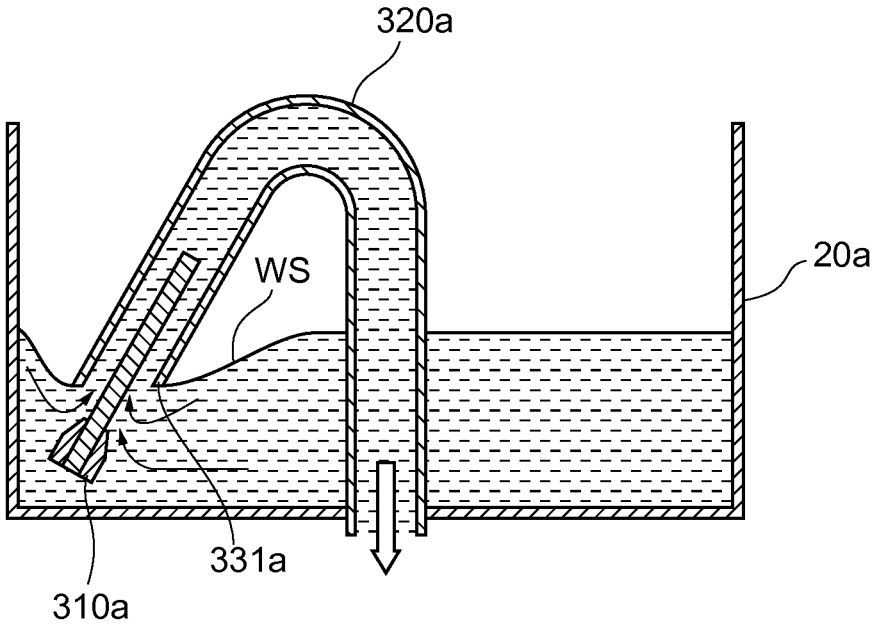
FIG. 12 is a diagram for explaining a phenomenon that not the entire water surface in the tank is horizontal.

To describe an effect of forming the second tank portion 220*a* below the suction port 331*a*, a phenomenon that not the entire water surface in the tank is horizontal will be described first with reference to FIG. 12. FIG. 12 is a schematic diagram depicted by viewing the inside of the tank 20*a* from the back side, schematically illustrating that the jet pump action is generated when the second tank portion 220*a* is not formed in the tank 20*a*.

Since the dimension of the tank 20*a* in the front-back direction is short in the present embodiment, the throat pipe 320*a* is arranged so that the central axis is substantially along the left-right direction when viewed from the top. The suction port 331*a* is arranged near the end portion on the left side inside of the tank 20*a*. Since the throat pipe 320*a* and the suction port 331*a* are arranged this way, the channel length of the throat pipe 320*a* necessary to efficiently generate the jet pump action is ensured, despite the fact that the dimension of the tank 20*a* in the front-back direction is small.

However, in a configuration in which the dimension of the tank 20*a* in the front-back direction is short, and the suction port 331*a* is arranged near the end portion on the left side (or right side), the water at a position far from the suction port 331*a* in the tank 20*a* may not be able to smoothly reach the suction port 331*a*. For example, as shown in FIG. 12, if the suction port 331*a* is arranged at a left end portion of the tank 20*a*, the water on the right side of the tank 20*a* cannot smoothly reach the suction port 331*a*, although the water on the left side of the tank 20*a* smoothly reaches the suction port 331*a*. As a result, not the entire water surface WS in the tank 20*a* is horizontal, and the water surface WS on the side (left side) with the suction port 331*a* is slightly lower than the water surface WS of the other (right side). If such a phenomenon occurs, the air in the tank 20*a* is sucked into the throat pipe 320*a*, despite the fact that washing is not completed. This reduces the efficiency of the jet pump action.

Figure 13:
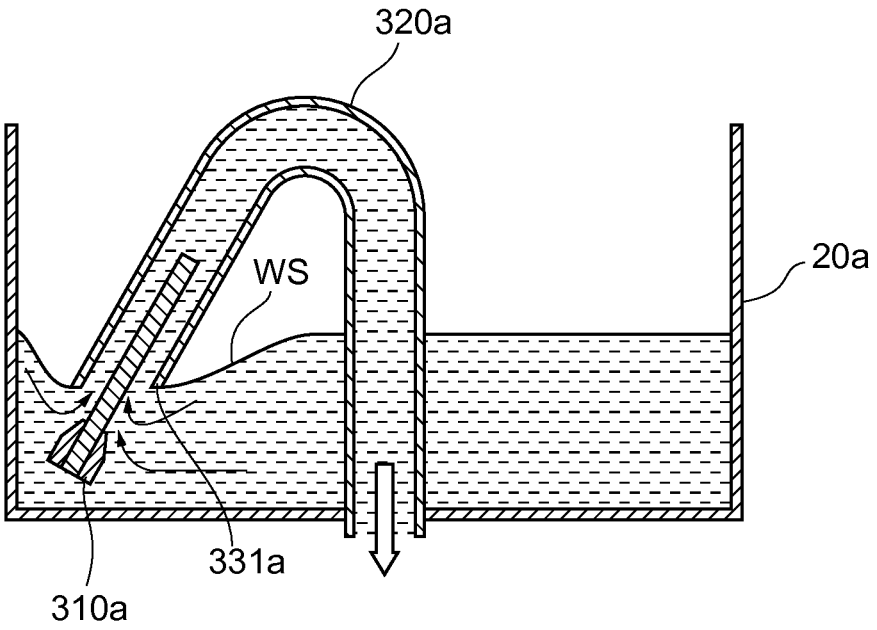
FIG. 13 is a diagram schematically showing a water flow inside of the tank of the flush toilet apparatus shown in FIG. 10.

On the other hand, in the present embodiment, the formation of the second tank portion 220*a* below the suction port 331*a* prevents the phenomenon that not the entire water surface WS is horizontal (phenomenon that part of the water surface WS is low). FIG. 13 is a diagram schematically showing a water flow inside of the tank 20*a* in the present embodiment.

The second tank portion 220*a* is formed below the suction port 331*a*, and a wide space is ensured in that part. Therefore, the water passes through various paths to head to the suction port 331*a*. More specifically, the water from near a right end portion of the tank 20*a* (position farthest from the suction port 331*a*) toward the suction port 331*a* can not only simply pass through a path in the horizontal direction, but can also pass through a path toward the suction port 331*a* after descending once to the proximity of the bottom wall 221*a* of the second tank portion 220*a* (path illustrated with reference sign FL in FIG. 13), for example. Since a wide path of water toward the suction port 331*a* is ensured, the flow of the water is smooth. The occurrence of the phenomenon that the water level near the suction port 331*a* drops first is suppressed, and the entire water surface WS in the tank 20*a* drops substantially horizontally. As a result, the air in the tank 20*a* is not sucked into the throat pipe 320*a*, and high washing performance by the jet pump action can be exerted.

The bottom wall 221*a* of the second tank portion 220*a* is arranged at a position not overlapping with the toilet body 10*a* when viewed from the top, on the lateral side of the toilet body 10*a* and on the lower side of the upper surface 101*a* of the toilet body 10*a*. According to the configuration, the dimension in the front-back direction and the dimension in the height direction of the entire flush toilet apparatus FTa are not enlarged by the formation of the second tank portion 220*a*. In other words, the second tank portion 220*a* is formed without changing the dimensions, and the reduction in the efficiency of the jet pump action is prevented.

Figure 14:
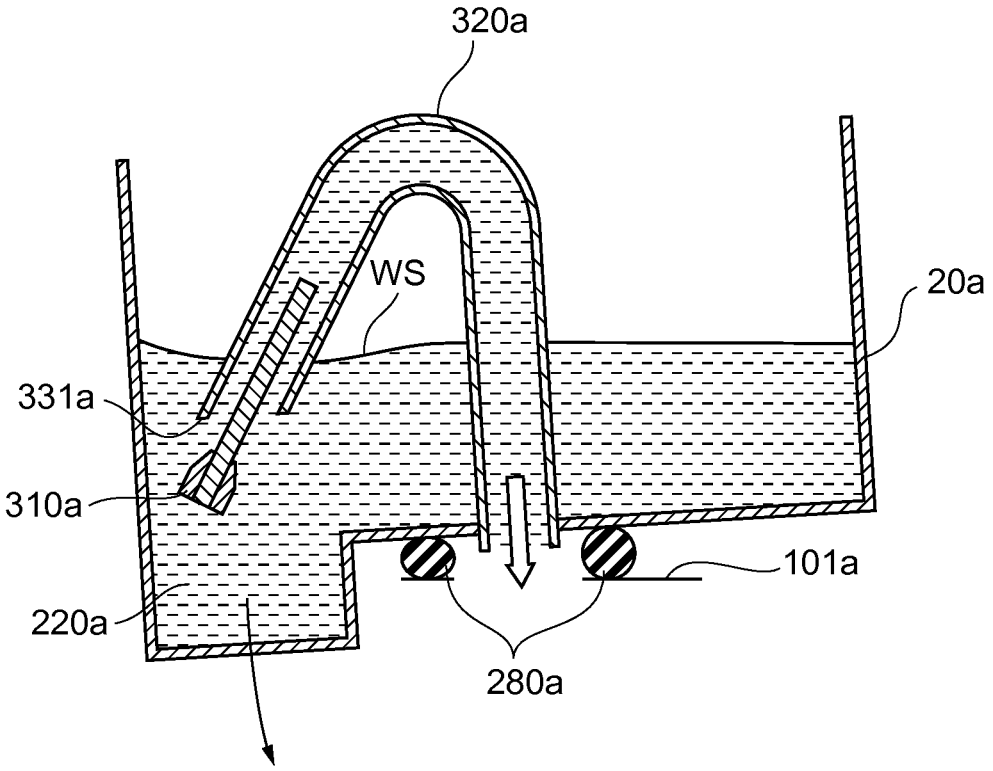
FIG. 14 is a diagram schematically showing an attachment structure of the tank in the flush toilet apparatus shown in FIG. 10.

In the present embodiment, the second tank portion 220*a* is formed only on the left side of the tank 20*a*, and the center of gravity of the entire water stored in the tank 20*a* is at a position closer to the left side (position closer to the arrangement of the suction port 331*a* in the left-right direction of the tank 20*a*). As shown in FIG. 14, O-rings 280*a* (elastic members) exist between the bottom of the tank 20*a* and the upper surface 101*a* of the toilet body 10*a*. More specifically, the tank 20*a* is installed on the upper surface 101*a* of the toilet body 10*a* through the elastic members. Therefore, the tank 20*a* can horizontally incline around the positions of the O-rings 280*a*, and the center of gravity of the entire water stored in the tank 20*a* is closer to the left side as described above. As a result, the tank 20*a* is easily inclined to the left side (to the side with the suction port 331*a*).

When the tank 20*a* inclines to the left side (to the side with the suction port 331*a*) by the weight of the tank 20*a*, the water stored in the tank 20*a* easily and smoothly reaches the suction port 331*a*. Therefore, the occurrence of the phenomenon that the water level near the suction port 331*a* of the throat pipe 320*a* drops first can be further suppressed.

In the present embodiment, the center of gravity of the stored water is biased to the left side by forming the second tank portion 220*a* only on the left side of the tank 20*a*, and the tank 20*a* inclines easily as described above. In a mode that the second tank portion 220*a* is formed on both of the left and right sides instead of only on the left side of the tank 20*a*, the tank 20*a* can be formed so that the capacity of the second tank portion 220*a* on the left side (on the side with the suction port 331*a*) is greater than the capacity of the second tank portion 220*a* on the right side (opposite side of the suction port 331*a*).

Arrangement of a water supply pipe 231*a*, etc., in the tank 20*a* will be described with reference again to FIGS. 10 and 11.

The water supply pipe 231*a* that is a pipe for supplying, from the outside (water pipe), water to be injected from the nozzle 310*a* is arranged inside of the tank 20*a*, extending upward from the bottom wall 211*a* of the tank 20*a*. In other words, the water supply pipe 231*a* is arranged so that the water stored inside of the tank 20*a* penetrates in the vertical direction.

The water supply pipe 231*a* is arranged at a part on the opposite side (right side) of the side (left side) where the suction port 331*a* is arranged in the left-right direction inside of the tank 20*a*. If there is an obstacle near the suction port 331*a*, the obstacle significantly inhibits the flow of water gathered to the suction port 331*a*. In the present embodiment, the water supply pipe 231*a* is arranged at a position far from the suction port 331*a*, and the water supply pipe 231*a* does not inhibit the flow of water toward the suction port 331*a* in the tank 20*a*. As a result, the occurrence of the phenomenon that the water level near the suction port 331*a* drops first is further suppressed.

A main valve 233*a* (open/close valve) for switching open/close of the channel for supplying water to the nozzle 310*a* and a float 238*a* connected to the main valve 233*a* are arranged inside of the tank 20*a*. In the present embodiment, the float 238*a* is arranged at a part on the opposite side (right side) of the side (left side) where the suction port 331*a* is arranged in the left-right direction inside of the tank 20*a*. Since the float 238*a* is arranged at a position far from the suction port 331*a*, the float 238*a* does not inhibit the flow of the water toward the suction port 331*a*. As a result, the occurrence of the phenomenon that the water level near the suction port 331*a* drops first can be further suppressed.

A small tank 260*a* for enabling to change the amount of water, of the stored water, to be supplied to an inlet of a water conduit 130*a* is arranged inside of the tank 20*a*. In the present embodiment, the small tank 260*a* is arranged at a position closer to the opposite side (right side) of the side (left side) where the suction port 331*a* is arranged in the left-right direction inside of the tank 20*a*. Since the small tank 260*a* is arranged at the position, the small tank 260*a* does not inhibit the flow of water toward the suction port 331*a*. As a result, the occurrence of the phenomenon that the water level near the suction port 331*a* drops first can be further suppressed.

The flush toilet apparatus FTa includes a channel switching mechanism 390*a* on a downstream end portion of the throat pipe 320*a* (between the suction port 331*a* and the nozzle 310*a*). The channel switching mechanism 390*a* includes a float 391*a*. The channel switching mechanism 390*a* is configured to switch a state that water injected from an injection port 311*a* of the nozzle 310*a* heads to the inside of the throat pipe 320*a* and a state that the water is supplied to the tank 20*a* (state that water is poured into the tank 20*a*), based on operation of the float 391*a* according to the water level of the tank 20*a*.

The channel switching mechanism 390*a* is configured to switch, from the inside of the throat pipe 320*a* to the tank 20*a*, the supply destination of the water injected from the injection port 311*a* when the water level in the tank 20*a* drops to a predetermined switch water level during supply of water to a bowl portion 110*a* (during jet pump action). More specifically, the jet pump action is stopped when the water level in the tank 20*a* drops to the switch water level, and pouring of water into the tank 20*a* is started. The switch water level is set to a position higher than an upper end position of the second tank portion 220*a*.

If the switch water level is set to a position lower than the upper end position of the second tank portion 220*a*, part of the water surface WS near the suction port 331*a* becomes locally lower than the other parts. As a result, air may flow into the throat pipe 320*a* from the suction port 331*a*, and noise may be generated.

The flow velocity of water tends to be low near the wall surface surrounding the circumference of the suction port 331*a* inside of the relatively narrow second tank portion 220*a*, and it is unlikely that the entire water surface WS drops uniformly. This can cause a local reduction of the water surface WS.

Therefore, the switch water level is set to a position higher than the upper end of the second tank portion 220*a* in the present embodiment. More specifically, the jet pump action is stopped before the state that the water exists only in the narrow second tank portion 220*a*, and pouring of water into the tank 20*a* is started. Therefore, the local reduction in the water surface WS does not occur, and the generation of noise in the water surface WS is prevented.

Although the channel is switched by the channel switching mechanism 390*a* as described above in the present embodiment, in place of this, the channel may be switched by a configuration similar to the flush toilet apparatus FT in the first embodiment.

In the present embodiment, the suction port 331*a* is arranged at a position substantially equivalent to the upper end of the second tank portion 220*a* as shown in FIG. 11. In place of the mode, the suction port 331*a* may be arranged at a position lower than the upper end of the second tank portion 220*a* (inside of the second tank portion 220*a*) to set the switch water level to a position lower than the upper end of the second tank portion 220*a*. According to the configuration, since the jet pump action works until the water exists only in the narrow second tank portion 220*a*, the amount of wasteful water is further reduced.

The embodiments of the present invention have been described with reference to the specific examples. However, the present invention is not limited to the specific examples. More specifically, appropriate design changes of the specific examples by those skilled in the art are also included in the scope of the present invention as long as the features of the present invention are included. For example, the elements as well as the arrangements, the materials, the conditions, the shapes, the sizes, etc., of the elements included in the specific examples are not limited to the illustrated ones, and appropriate changes can be made. The elements included in the embodiments can be combined if technically possible, and these combinations are also included in the scope of the present invention as long as the features of the present invention are included.

What is claimed is:

1. A flush toilet apparatus that discharges waste to a drain pipe by wash water, the flush toilet apparatus comprising:

a toilet body comprising a bowl portion that receives waste, wherein a water conduit for guiding water supplied as wash water to the bowl portion is formed inside;

a tank storing water inside and arranged to be able to supply the water to an inlet of the water conduit; and a jet pump unit arranged inside of the tank, the jet pump unit comprising:

a throat pipe, wherein one end is connected to the inlet of the water conduit, a suction port is formed on the other end, a central axis of the throat pipe is arranged to be substantially along a left-right direction of the tank when viewed from the top, and the suction port is arranged to be positioned at a lower part near one of left and right end portions inside of tank; and a nozzle that injects high-speed water toward the inside of the throat pipe from the suction port to induce a jet pump action, wherein the tank is installed at a part on a backward side of an upper surface of the toilet body and comprises: a first tank portion; and a second tank portion formed so as to extend part of a bottom wall of the first tank portion downward, at least part of the second tank portion is formed at a position overlapping with the suction port when viewed from the top, and a bottom wall of the second tank portion does not overlap with the toilet body when viewed from the top and is arranged at a position on a lateral side of the toilet body and on a lower side of the upper surface of the toilet body.

2. The flush toilet apparatus according to claim 1, wherein to set a center of gravity of entire water stored in the tank to a position closer to a side with the suction port in the left-right direction of the tank, the second tank portion is formed so that a capacity of the side with the suction port is greater than a capacity of a side without the suction port.

3. The flush toilet apparatus according to claim 2, wherein the tank is installed on the upper surface of the toilet body through an elastic member.

4. The flush toilet apparatus according to claim 1, wherein an entire edge of the suction port is formed along a horizontal surface.

5. The flush toilet apparatus according to claim 1, wherein a water supply pipe that is a pipe for supplying water to be injected from the nozzle is arranged inside of the tank, extending upward from a bottom wall of the tank, and the water supply pipe is arranged at a part on an opposite side of the side with the suction port in the left-right direction of the toilet body.

6. The flush toilet apparatus according to claim 5, wherein inside of the tank, an open/close valve for switching open/close of a channel for supplying water to the nozzle and a float connected to the open/close valve are arranged, and the float is arranged at a part on the opposite side of the side with the suction port in the left-right direction of the toilet body inside of the tank.

7. The flush toilet apparatus according to claim 6, wherein a small tank for enabling to change an amount of water, of the stored water, to be supplied to the inlet of the water conduit is arranged inside of the tank, and the small tank is arranged at a position closer to the opposite side of the side with the suction port in the left-right direction of the toilet body inside of the tank.

* * * * *